US006743005B1

(12) United States Patent
Leemhuis

(10) Patent No.: US 6,743,005 B1
(45) Date of Patent: Jun. 1, 2004

(54) GEROTOR APPARATUS WITH BALANCE GROOVES

(75) Inventor: Richard Scott Leemhuis, Rochester Hills, MI (US)

(73) Assignee: Valeo Electrical Systems, Inc., Auburn Hills, MI (US)

( * ) Notice: Subject to any disclaimer, the term of this patent is extended or adjusted under 35 U.S.C. 154(b) by 0 days.

(21) Appl. No.: 10/329,622

(22) Filed: Dec. 26, 2002

(51) Int. Cl.[7] ..... F04C 18/00
(52) U.S. Cl. ..... 418/171; 418/71
(58) Field of Search ..... 418/71, 61.3, 171

(56) References Cited

U.S. PATENT DOCUMENTS

| | | | | |
|---|---|---|---|---|
| 3,034,448 A | | 5/1962 | Brundage | |
| 3,680,989 A | * | 8/1972 | Brundage | 418/71 |
| 4,199,305 A | | 4/1980 | Pareja | |
| 4,411,606 A | * | 10/1983 | Miller | 418/61.3 |
| 4,717,320 A | | 1/1988 | White, Jr. | |
| 4,820,138 A | * | 4/1989 | Bollinger | 418/71 |
| 4,976,594 A | | 12/1990 | Bernstrom | |
| 6,086,345 A | | 7/2000 | Acharya et al. | |
| 6,195,990 B1 | | 3/2001 | Machesney et al. | |

FOREIGN PATENT DOCUMENTS

| | | | | |
|---|---|---|---|---|
| CA | 0941678 | * | 2/1974 | 418/71 |

* cited by examiner

*Primary Examiner*—Thomas Denion
*Assistant Examiner*—Theresa Trieu
(74) *Attorney, Agent, or Firm*—Jacox, Meckstroth & Jenkins

(57) ABSTRACT

A gerotor motor having an inner gerotor positioned within an outer gerotor, a housing radially surrounding the outer gerotor, a cover plate positioned adjacent the outer gerotor and pressure balance grooves extending between the outer gerotor/cover plate interface and a region of radial clearance between the outer gerotor and the housing. Three such balance grooves are disclosed. They include an inlet balance groove, an outlet balance groove and an axial balance groove. These grooves serve to balance axial and radial hydraulic pressure forces acting on the outer gerotor. The resulting net pressure force is substantially independent of both inlet and outlet pressure.

39 Claims, 10 Drawing Sheets

GEROTOR APPARATUS WITH BALANCE GROOVES

BACKGROUND OF THE INVENTION

1. Field of the Invention

This invention relates to an improved hydraulic motor, and more particularly to a gerotor hydraulic motor having balance grooves configured for controlling hydraulic forces acting on a set of gerotor gears, so as to minimize frictional losses and maximize torque delivered to a load.

2. Description of the Related Art

Gerotor hydraulic motors are well known in the art. They comprise an inner gear and an outer gear, the axes of which are offset by a fixed distance. The inner gear is disposed interiorly of the outer gear and has exteriorly facing teeth that mesh with interiorly facing teeth on the outer gear. The outer gear is sized to have a sliding fit within a cylindrical housing. The inner gear is keyed to a driven shaft and meshes with the outer gear. The inner gear has one less tooth than the outer gear. The shape of the gear teeth is such that each tooth of the inner gear is always in sliding contact with a tooth of the outer gear. The resulting geometry creates discrete, multiple chambers that change from minimum to maximum and back to minimum volume for each rotation of the shaft.

A typical gerotor motor is driven by hydraulic fluid, received into a kidney-shaped chamber known as an inlet kidney port and discharged from a kidney-shaped chamber, known as an outlet kidney port. The flow of fluid past the inlet kidney port and into the gears causes rotation of the gear set as the gear chambers transition from minimum to maximum volume. The fluid is discharged through the outlet kidney port as the gear chambers transition from maximum to minimum volume. The hydraulic pressure drop between the inlet and outlet kidney ports varies from time to time as a function of resistive shaft torque, friction and volumetric displacement of the gear set. Further information regarding the construction and operation of gerotor devices may be found in Pareja. U.S. Pat. No. 4,199,305.

Gerotors may be used in pump applications, as well as in motor applications. In fact, gerotor pumps have a proven record of reliability and performance and are employed much more commonly than gerotor motors. One reason for this is the tendency of a gerotor motor to stall at initial start-up, even when no torsional load is applied to the motor shaft. Increasing the inlet pressure may help initiate rotation, but sometimes this only causes further binding of the shaft. Usually, a motor that begins to turn will continue to do so until the next time it comes to a complete stop.

Those skilled in the art will recognize this phenomenon as "hydraulic lock-up", characterized by an unbalanced hydraulic force acting on one or both gerotor gears, resulting in high static friction. The frictional forces often increase as pressure increases, sometimes consuming all of the torque generated by the motor. If the motor does begin to rotate, the friction from the hydraulic imbalance reduces the motor's torsional efficiency and generates undesirable heat. This problem occurs in gerotor pumps, as well as gerotor motors. In that regard reference may be made to Pareja mentioned earlier herein.

FIG. 1 shows a typical radial pressure gradient in a prior art hydraulic gerotor motor. It may be observed that the inlet and outlet pressures act on the inner gear and cause a side load on the shaft. This load is supported by the shaft bearings. Torsional friction is minimal because of the small moment arm from the shaft axis to the shaft bearings. The inlet and outlet pressures also act on the outer gear and cause a similar side load against the housing gerotor bore. This can create significantly more torsional friction due to the larger moment arm. Note that there may be a starter-groove that ports fluid between the inside and outside of the outer gear. The purpose of this groove is to help balance the net radial pressure forces acting on the outer gear. Gerotor motor and pump manufacturers often use one or more starter-grooves. While these grooves offer limited improvement, experience has shown they do not provide consistent hydraulic balance required for a motor that starts reliably.

FIG. 1 shows why starter grooves are unreliable. Note that the radial pressure gradient varies from inlet pressure on the right side of the drawing (at the starter groove) to "some" low pressure on the left side of the drawing. The exact magnitude of the pressure is not defined except at the starter groove. Thus, for about 350 degrees of rotation, the pressure on the outside of the outer gerotor depends on radial and axial clearances, temperature and surface finish. If we find the sum of the hydraulic forces acting radially on the outside of the outer gerotor and add this to the sum of the hydraulic forces acting radially on the inside of the outer gerotor, the result should be near zero. Tolerances cause variations in the outside pressure gradient and the result is some will be poor starters. This is unacceptable for automotive cooling applications that must start every day, every time, at all temperatures for every motor produced.

Hydraulic balance is well known to engineers who design hydraulic pumps or motors.

Pumps are hydraulically balanced to reduce internal wear on rubbing parts and to minimize heat generation. This improves torsional efficiency. Pumps are typically driven by an electric motor and rarely (if ever) have a no-start problem as long as the motor can overcome the initial pump torsional friction. Once a pump begins to spin, a lubrication film builds up and tends to reduce rubbing friction. Note as well that typically hydraulic pressure is not generated until the pump begins to spin.

Hydraulic motors are especially sensitive to stalling unless they are "hydraulically balanced". Note that the generated torque increases as pressure increases but the frictional torque also increases as pressure increases. If the frictional torque is equal to the generated torque, the motor will not spin. This is called "hydraulic lock" and is eliminated by hydraulically balancing the rubbing parts. However, prior to this invention there has been no fully satisfactory method for balancing gerotor motors. Existing gerotor balancing schemes have likely been aimed at gerotor pumps, not gerotor motors.

For years, engineers who design gerotor pumps and motors have attempted to balance them with "starter grooves" in the gerotor bore. A good example is found in starter grooves 44, 46 shown Pareja U.S. Pat. No. 4,199,305. These starter grooves represent the current "state-of-the-art" in gerotor pump and motor design and are commonly used in all designs. Unfortunately, they do not reliably minimize torsional friction and motors using these grooves will often stall.

FIG. 2 illustrates a typical axial pressure gradient in a prior art hydraulic gerotor motor and shows another deficiency of the prior art. Torsional efficiency is improved when the axial pressure gradient is the same on both sides of the inner and outer gears. This is particularly true of the outer gear since its moment arm to the shaft axis is larger than that of the inner gear. Often overlooked is the effect of radial leakage between the housing and cover plate. This leakage can be due to either an O-ring groove or to a low-pressure cavity. The leakage distorts the pressure gradient acting on the outer gear resulting in an axial pressure imbalance. A large undercut can similarly distort the axial (and radial) pressure gradient and further reduce torsional efficiency.

Another deficiency of the prior art is extreme sensitivity to gerotor/bore dimensional tolerances. Small variations in axial or radial clearances can dramatically change the critical radial and axial pressure gradients. In addition, temperature and surface finish can also cause wide variations in a motor's torsional efficiency and, ultimately, ability to initiate rotation.

The invention described herein addresses these deficiencies of the prior art and offers much improved motor starting capability. While this invention is primarily directed at gerotor motors, those skilled in the art will recognize the benefits of this invention for gerotor pumps as well. The balance grooves defined by this invention reduce friction and improve torsional efficiency.

SUMMARY OF THE INVENTION

An object of this invention is to provide a gerotor device having improved torsional efficiency. A more particular object is to improve the startup torsional efficiency of a gerotor-type hydraulic motor. These objects are accomplished through the use of balance grooves between the clamped sealing surfaces of a gerotor housing and cover plate. In the preferred embodiment there are three such balance grooves. They include an inlet balance groove, an outlet balance groove and an axial balance groove. These grooves are located such that they are in direct contact with fluid at the periphery of the outer gear. They serve to balance axial and radial hydraulic pressure forces acting on the outer gear. The resulting net pressure force is substantially independent of both inlet and outlet pressure. This minimizes friction between the outer gear, housing and cover plate at all operating pressures; thereby improving motor starting capability and operating torsional efficiency.

Prior art hydraulic gerotor motors not equipped with the balance grooves of this invention have axial and radial pressure forces acting on the outer gear largely dependent on clearances, leakage and operating pressure. Small motor-to-motor dimensional variations can cause significant variations in the ability of a motor to start. This invention reduces the sensitivity to these clearances as well as variations of temperature, pressure, surface finish, and assembly.

In one aspect this invention comprises a hydraulic gerotor motor comprising: a housing provided with a cylindrical gerotor bore, an outer gerotor gear mounted within the gerotor bore, the outer gerotor gear having a smooth, cylindrical outer perimeter facing the gerotor bore to define a region of radial clearance therebetween, and an inner perimeter equipped with inwardly extending teeth, an inner gerotor gear mounted within the outer gerotor gear, the inner gerotor gear having outwardly extending teeth engaging the inwardly extending teeth of the outer gerotor gear, an inlet port situated for receiving a flow of hydraulic fluid and delivering the hydraulic fluid to a region of engagement between the inwardly extending teeth and the outwardly extending teeth an outlet port situated for discharging used hydraulic fluid from the device and a pressure balancing passage extending between the region of radial clearance and the inlet port, the pressure balancing passage having an arc length greater than 10 degrees.

In another aspect this invention comprises a hydraulic gerotor motor comprising: a manifold provided with a cylindrical gerotor bore, an outer gerotor gear mounted centrally within the gerotor bore, the outer gerotor gear having a smooth, cylindrical outer perimeter facing the gerotor bore to define a region of radial clearance therebetween, and an inner perimeter equipped with inwardly extending teeth, an inner gerotor gear mounted within the outer gerotor gear, the inner gerotor gear having outwardly extending teeth engaging the inwardly extending teeth of the outer gerotor gear, an inlet port situated for receiving a flow of hydraulic fluid and delivering the hydraulic fluid to a region of engagement between the inwardly extending teeth and the outwardly extending teeth, an outlet port situated for discharging used hydraulic fluid from the device, and a pressure balancing passage extending between the region of radial clearance and the outlet port, the pressure balancing passage having an arc length greater than 10 degrees.

In still another aspect this invention comprises a hydraulic gerotor motor comprising: a manifold provided with pocket having a cylindrical side wall defined by a blind cylindrical opening extending perpendicularly into a plane surface, a cover plate clamped against the plane surface to seal the pocket, a cylindrical shaft extending into the pocket coaxially with the cylindrical opening an outer gerotor gear mounted within the pocket, the outer gerotor gear having a smooth, cylindrical outer perimeter facing the cylindrical side wall to define a region of radial clearance therebetween, an inner perimeter equipped with inwardly extending teeth and a planar mounting surface extending between the inner perimeter and the outer perimeter, the planar mounting surface being sealingly clamped against the cover plate an inner gerotor gear mounted within the outer gerotor gear, the inner gerotor gear having outwardly extending teeth engaging the inwardly extending teeth of the outer gerotor gear, an inlet port situated for receiving a flow of pressurized hydraulic fluid and delivering the hydraulic fluid to a region of engagement between the inwardly extending teeth and the outwardly extending teeth, an outlet port situated for discharging used hydraulic fluid from the device, and a pressure balancing passage extending between the region of radial clearance and the inlet port, the pressure balancing passage having an arc length greater than 10 degrees.

In yet another aspect this invention comprises a gerotor apparatus comprising: a manifold having a substantially planar first face and a pocket having a cylindrical side wall extending into the first face, a rotatable shaft extending axially into the pocket, an inner gerotor gear secured to the shaft and situated entirely within the pocket, the inner gerotor gear having a substantially planar second face coplanar with the first face and a circular perimeter provided with outwardly facing teeth, a generally annular outer gear having a smooth cylindrically extending outer gear perimeter, and a substantially planar third face, the outer gear being positioned inside the pocket such that the third face is coplanar with the second face, the outer gear also having a generally circular interior opening which is configured to define a number of uniformly spaced teeth extending radially inward, the number of teeth on the outer gear being one greater than the number of teeth on the inner gear, the outer gear being further positioned such that the inner gear is fitted within the opening of the outer gear and the inwardly extending teeth are in engagement with the outwardly extending teeth, the outer gear being still further positioned so as to define a region of radial clearance, a cover plate sealed against the third face and the second face to define a region of radial clearance between the side wall and the smooth outer gear perimeter, an inlet port connected to receive a supply of pressurized hydraulic fluid for delivery to a working region between the inner gear teeth and the outer gear teeth, an outlet port connected for discharging used hydraulic fluid from the device, and a pressure balancing passage extending between the region of radial clearance and the inlet port, the pressure balancing passage having an arc length greater than 10 degrees.

In still another aspect this invention comprises a method of operating a hydraulic gerotor motor of a type comprising a housing provided with a cylindrical gerotor bore, an outer gerotor gear mounted within the gerotor bore, the outer gerotor gear having an inner perimeter equipped with inwardly extending teeth, an inner gerotor gear mounted rotatably within the outer gerotor gear, the inner gerotor gear having outwardly extending teeth engaging the inwardly extending teeth of the outer gerotor gear, the outwardly extending teeth being fewer in number than the inwardly extending teeth, so that each tooth of the inner gerotor gear is always in sliding contact with a tooth of the outer gerotor gear thereby forming discrete multiple chambers which continuously change in size from a minimum to a maximum and back to a minimum with each rotation of the inner gerotor gear and an output shaft connected to and driven by the inner gerotor gear, the method comprising the steps of: delivering a hydraulic fluid to the chambers at a pressure and in a direction which balances all of the hydraulic forces acting on the outer gerotor gear, thereby avoiding frictional losses due to contact between the outer gerotor gear and the housing, and removing the hydraulic fluid from the chambers as they change in size from a maximum to a minimum.

In yet anther aspect this invention comprises a hydraulic device comprising at least one passage connecting inlet pressure to a radial clearance area between an outer gerotor and outer gerotor bore defining an inlet pressure region at the radial clearance, the center of the inlet pressure region being located at a first predetermined number of degrees from a radial line perpendicular to a gerotor offset and having an arc length a second predetermined number of degrees.

In still another aspect this invention comprises a hydraulic gerotor motor comprising a housing with first planar surface, a pocket defined by a blind cylindrical opening extending perpendicularly into the first planar surface, the pocket having a cylindrical side wall terminated by second planar surface, the second planar surface parallel to first planar surface, a cover plate with planar surface clamped against the housing first planar surface to seal the pocket, an outer gerotor gear mounted within the pocket, the outer gerotor gear having a cylindrical outer perimeter facing the cylindrical side wall to define a region of radial clearance there between, inner perimeter of the outer gerotor gear equipped with inwardly extending teeth, the outer gerotor gear having two planar parallel surfaces perpendicular to the cylindrical outer perimeter, the planar surfaces providing a close running fit between housing second planar surface and the cover plate planar surface an inner gerotor gear mounted within the outer gerotor gear, the inner gerotor gear having outwardly extending teeth engaging the inwardly extending teeth of the outer gerotor gear, the inner gear having one less tooth than outer gear, a output shaft connected to and driven by the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the inlet port, the pressure balancing passage causing creation of an inlet pressure region at the region of radial clearance, the inlet pressure region being centered within 20 degrees of a radial line from axis of the outer gerotor gear and perpendicular to a line joining the inner gerotor gear center and the outer gerotor gear center, the inlet pressure region having an arc length greater than 30 degrees.

In still another aspect this invention comprises a hydraulic gerotor motor comprising: a housing with first planar surface, a pocket defined by a blind cylindrical opening extending perpendicularly into the first planar surface, the pocket having a cylindrical side wall terminated by second planar surface, the second planar surface parallel to first planar surface, a cover plate with planar surface clamped against the housing first planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between housing second planar surface and the cover plate planar surface, an inner gerotor gear mounted within the outer gerotor gear, the inner gerotor gear having outwardly extending teeth engaging the inwardly extending teeth of the outer gerotor gear, the inner gear having one less tooth than outer gear, a output shaft connected to and driven by the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the outlet port, the pressure balancing passage causing creation of an outlet pressure region at the region of radial clearance, the outlet pressure region being centered within 20 degrees of a radial line from axis of the outer gerotor gear and perpendicular to a line joining the inner gerotor gear center and the outer gerotor gear center, the outlet pressure region having an arc length greater than 90 degrees.

In yet another aspect this invention comprises a hydraulic gerotor motor comprising: a housing with first planar surface, a pocket defined by a blind cylindrical opening extending perpendicularly into the first planar surface, the pocket having a cylindrical side wall terminated by second planar surface, the second planar surface parallel to first planar surface, a cover plate with planar surface clamped against the housing first planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between housing second planar surface and the cover plate planar surface, an inner gerotor gear mounted within the outer gerotor gear, the inner gerotor gear having outwardly extending teeth engaging the inwardly extending teeth of the outer gerotor gear, the inner gear having one less tooth than outer gear, a output shaft connected to and driven by the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage defining an axial balance groove, the axial balance groove extending from the region of radial clearance, extending between the cover plate and the housing at a radius outside the region of radial clearance and extending to a second contact with the region of radial clearance.

In still another aspect this invention comprises a hydraulic gerotor motor comprising: a housing with two planar and parallel surfaces, a cylindrical opening extending perpendicularly through both planar surfaces defining a cylindrical side wall, a first cover plate with planar surface clamped against the housing planar surface to define a pocket, a second cover plate with planar surface clamped against second of the housing planar surface to seal the pocket, an outer gerotor gear mounted within the pocket, the outer gerotor gear having a cylindrical outer perimeter facing the cylindrical side wall to define a region of radial clearance there between, inner perimeter of the outer gerotor gear equipped with inwardly extending teeth, the outer gerotor gear having two planar parallel surfaces perpendicular to the cylindrical outer perimeter, the planar surfaces providing a close running fit between the first cover plate and second cover plate, an inner gerotor gear mounted within the outer gerotor gear, the inner gerotor gear having outwardly extending teeth engaging the inwardly extending teeth of the outer gerotor gear, the inner gear having one less tooth than outer gear, a output shaft connected to and driven by the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the inlet port, the pressure balancing passage causing creation of an inlet pressure region at the region of radial clearance, the inlet pressure region being centered within 20 degrees of a radial line from axis of the outer gerotor gear and perpendicular to a line joining the inner gerotor gear center and the outer gerotor gear center, the inlet pressure region having an arc length greater than 30 degrees.

In yet another aspect this invention comprises a hydraulic gerotor motor comprising: a housing with two planar and parallel surfaces, a cylindrical opening extending perpendicularly through both planar surfaces defining a cylindrical side wall, a first cover plate with planar surface clamped against the housing planar surface to define a pocket, a second cover plate with planar surface clamped against second of the housing planar surface to seal the pocket, an outer gerotor gear mounted within the pocket, the outer gerotor gear having a cylindrical outer perimeter facing the cylindrical side wall to define a region of radial clearance there between, inner perimeter of the outer gerotor gear equipped with inwardly extending teeth, the outer gerotor gear having two planar parallel surfaces perpendicular to the cylindrical outer perimeter, the planar surfaces providing a close running fit between the first cover plate and second cover plate, an inner gerotor gear mounted within the outer gerotor gear, the inner gerotor gear having outwardly extending teeth engaging the inwardly extending teeth of the outer gerotor gear, the inner gear having one less tooth than outer gear, a output shaft connected to and driven by the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the outlet port, the pressure balancing passage causing creation of an outlet pressure region at the region of radial clearance, the outlet pressure region being centered within 20 degrees of a radial line from axis of the outer gerotor gear and perpendicular to a line joining the inner gerotor gear center and the outer gerotor gear center, the inlet pressure region having an arc length greater than 30 degrees.

In still another aspect this invention comprises a hydraulic gerotor motor comprising: a housing with two planar and parallel surfaces, a cylindrical opening extending perpendicularly through both planar surfaces defining a cylindrical side wall, a first cover plate with planar surface clamped against the housing planar surface to define a pocket, a second cover plate with planar surface clamped against second of the housing planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between the first cover plate and second cover plate, an inner gerotor gear mounted within the outer gerotor gear, the inner gerotor gear having outwardly extending teeth engaging the inwardly extending teeth of the outer gerotor gear, the inner gear having one less tooth than outer gear, a output shaft connected to and driven by the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage defining an axial balance groove, the axial balance groove extending from the region of radial clearance, extending between the first cover plate and the housing at a radius outside the region of radial clearance and extending to a second contact with the region of radial clearance.

In yet another aspect this invention comprises a hydraulic gerotor pump comprising: a housing with first planar surface, a pocket defined by a blind cylindrical opening extending perpendicularly into the first planar surface, the pocket having a cylindrical side wall terminated by second planar surface, the second planar surface parallel to first planar surface, a cover plate with planar surface clamped against the housing first planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between housing second planar surface and the cover plate planar surface, an inner gerotor gear mounted within the outer gerotor gear, the inner gerotor gear having outwardly extending teeth engaging the inwardly extending teeth of the outer gerotor gear, the inner gear having one less tooth than outer gear, an input shaft connected to and driving the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the inlet port, the pressure balancing passage causing creation of an inlet pressure region at the region of radial clearance, the inlet pressure region being centered within 20 degrees of a radial line from axis of the outer gerotor gear and perpendicular to a line joining the inner gerotor gear center and the outer gerotor gear center, the inlet pressure region having an arc length greater than 90 degrees.

In still another aspect this invention comprises a hydraulic gerotor pump comprising: a housing with first planar surface, a pocket defined by a blind cylindrical opening extending perpendicularly into the first planar surface, the pocket having a cylindrical side wall terminated by second planar surface, the second planar surface parallel to first planar surface, a cover plate with planar surface clamped against the housing first planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between housing second planar surface and the cover plate planar surface, an inner gerotor gear mounted within the outer gerotor gear, the inner gerotor gear having outwardly extending teeth engaging the inwardly extending teeth of the outer gerotor gear, the inner gear having one less tooth than outer gear, an input shaft connected to and driving the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the outlet port, the pressure balancing passage causing creation of an outlet pressure region at the region of radial clearance, the outlet pressure region being centered within 20 degrees of a radial line from axis of the outer gerotor gear and perpendicular to a line joining the inner gerotor gear center and the outer gerotor gear center, the outlet pressure region having an arc length greater than 30 degrees.

In still another aspect this invention comprises a hydraulic gerotor pump comprising: a housing with first planar surface, a pocket defined by a blind cylindrical opening extending perpendicularly into the first planar surface, the pocket having a cylindrical side wall terminated by second planar surface, the second planar surface parallel to first planar surface, a cover plate with planar surface clamped against the housing first planar surface to seal the pocket, an outer gerotor gear mounted within the pocket, the outer gerotor gear having a cylindrical outer perimeter facing the cylindrical side wall to define a region of radial clearance there between, inner perimeter of the outer gerotor gear equipped with inwardly extending teeth, the outer gerotor gear having two planar parallel surfaces perpendicular to the cylindrical outer perimeter, the planar surfaces providing a close running fit between housing second planar surface and the cover plate planar surface, an inner gerotor gear mounted within the outer gerotor gear, the inner gerotor gear having outwardly extending teeth engaging the inwardly extending teeth of the outer gerotor gear, the inner gear having one less tooth than outer gear, an input shaft connected to and driving the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage defining an axial balance groove, the axial balance groove extending from the region of radial clearance, extending between the cover plate and the housing at a radius outside the region of radial clearance and extending to a second contact with the region of radial clearance.

In another aspect this invention comprises a hydraulic gerotor pump comprising: a housing with two planar and parallel surfaces, a cylindrical opening extending perpendicularly through both planar surfaces defining a cylindrical side wall, a first cover plate with planar surface clamped against the housing planar surface to define a pocket, a second cover plate with planar surface clamped against second of the housing planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between the first cover plate and second cover plate, an inner gerotor gear mounted within the outer gerotor gear, the inner gerotor gear having outwardly extending teeth engaging the inwardly extending teeth of the outer gerotor gear, the inner gear having one less tooth than outer gear, an input shaft connected to and driving the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid, and a pressure balancing passage extending between the region of radial clearance and the inlet port, the pressure balancing passage causing creation of an inlet pressure region at the region of radial clearance, the inlet pressure region being centered within 20 degrees of a radial line from axis of the outer gerotor gear and perpendicular to a line joining the inner gerotor gear center and the outer gerotor gear center, the inlet pressure region having an arc length greater than 90 degrees.

In yet another aspect this invention comprises a hydraulic gerotor pump comprising a housing with two planar and parallel surfaces, a cylindrical opening extending perpendicularly through both planar surfaces defining a cylindrical side wall, a first cover plate with planar surface clamped against the housing planar surface to define a pocket, a second cover plate with planar surface clamped against second of the housing planar surface to seal the pocket, an outer gerotor gear mounted within the pocket, the outer gerotor gear having a cylindrical outer perimeter facing the cylindrical side wall to define a region of radial clearance there between. inner perimeter of the outer gerotor gear equipped with inwardly extending teeth, the outer gerotor gear having two planar parallel surfaces perpendicular to the cylindrical outer perimeter, the planar surfaces providing a close running fit between the first cover plate and second cover plate, an inner gerotor gear mounted within the outer gerotor gear, the inner gerotor gear having outwardly extending teeth engaging the inwardly extending teeth of the outer gerotor gear, the inner gear having one less tooth than outer gear, an input shaft connected to and driving the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid and a pressure balancing passage extending between the region of radial clearance and the outlet port, the pressure balancing passage causing creation of an outlet pressure region at the region of radial clearance, the outlet pressure region being centered within 20 degrees of a radial line from axis of the outer gerotor gear and perpendicular to a line joining the inner gerotor gear center and the outer gerotor gear center, the inlet pressure region having an arc length greater than 30 degrees.

In still another aspect this invention comprises a hydraulic gerotor pump comprising a housing with two planar and parallel surfaces, a cylindrical opening extending perpendicularly through both planar surfaces defining a cylindrical side wall, a first cover plate with planar surface clamped against the housing planar surface to define a pocket, a second cover plate with planar surface clamped against second of the housing planar surface to seal the pocket, an outer gerotor gear mounted within the pocket, the outer gerotor gear having a cylindrical outer perimeter facing the cylindrical side wall to define a region of radial clearance there between. inner perimeter. of the outer gerotor gear equipped with inwardly extending teeth, the outer gerotor gear having two planar parallel surfaces perpendicular to the cylindrical outer perimeter, the planar surfaces providing a close running fit between the first cover plate and second cover plate, an inner gerotor gear mounted within the outer gerotor gear, the inner gerotor gear having outwardly extending teeth engaging the inwardly extending teeth of the outer gerotor gear, the inner gear having one less tooth than outer gear, an input shaft connected to and driving the inner gerotor gear, an inlet port situated for receiving flow of hydraulic fluid and delivering the hydraulic fluid to a region of engagement between the inwardly extending teeth and the outwardly extending teeth, an outlet port situated for discharging used hydraulic fluid and a pressure balancing passage defining an axial balance groove, the axial balance groove extending from the region of radial clearance, extending between the first cover plate and the housing at a radius outside the region of radial clearance and extending to a second contact with the region of radial clearance.

The advantages offered by the invention will become apparent to those skilled in the art upon reading the attached detailed description of the preferred embodiment and with the aid of the accompanying drawings.

DESCRIPTION OF THE PREFERRED EMBODIMENT

Figure 3:
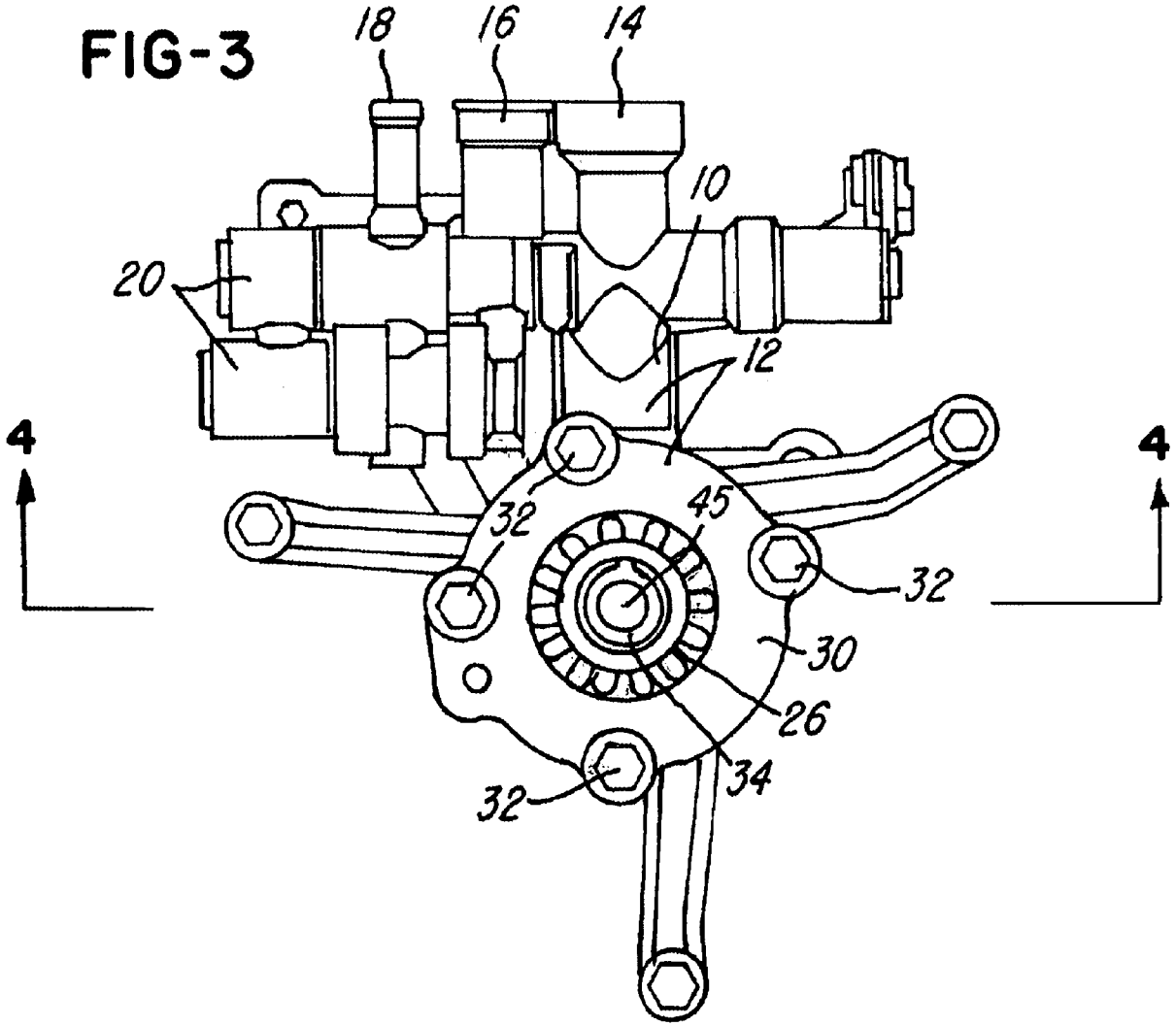
FIG. 3 is a sketch of a dual gerotor motor as viewed from its shaft end.
Figure 4:
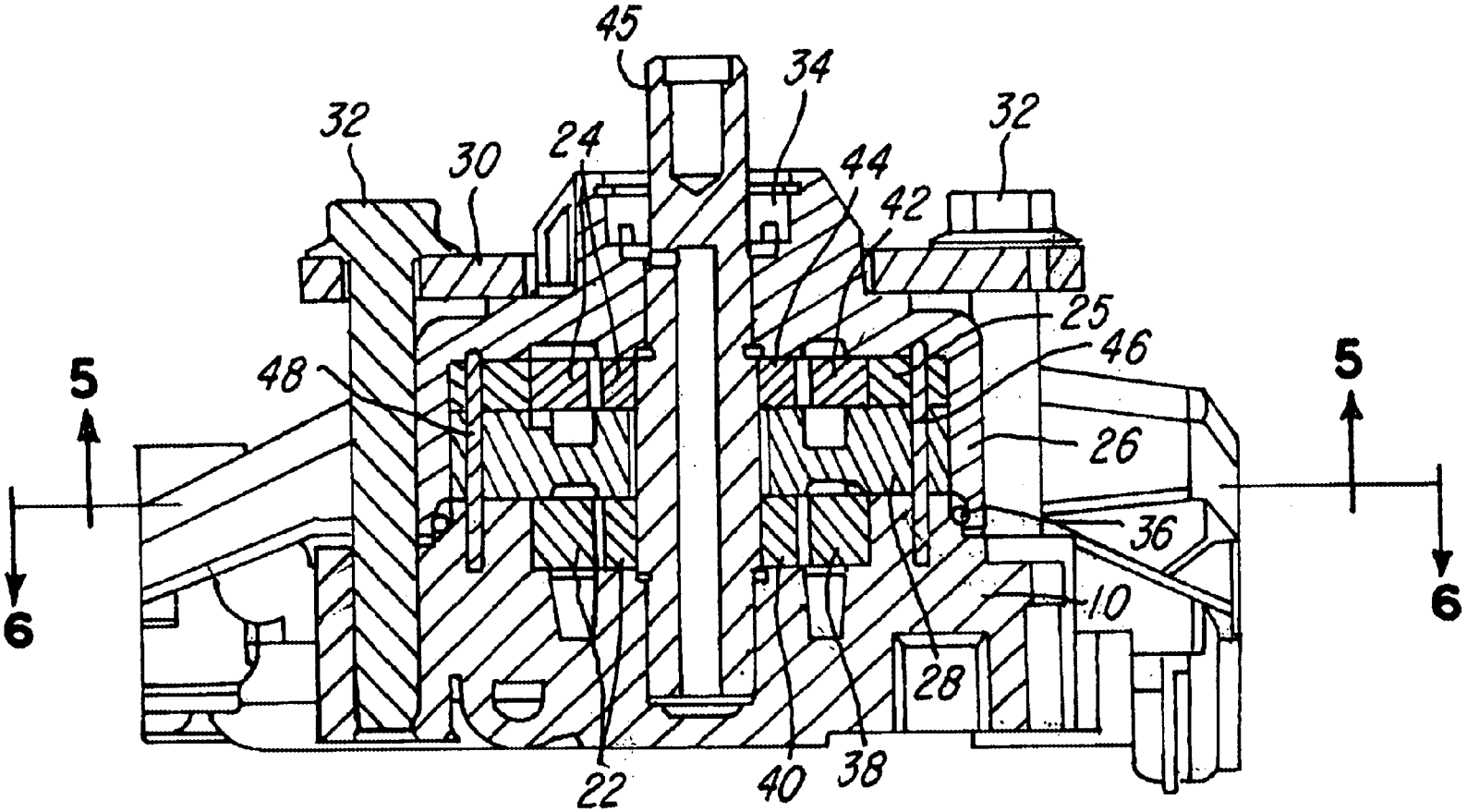
FIG. 4 is a cross-sectional view of a dual gerotor motor, taken along lines 4—4 of FIG. 3.

The following describes the preferred embodiment of this invention, as implemented on a dual hydraulic gerotor motor. Dual hydraulic motors are particularly useful in automotive cooling systems as described, for example, in Buschur U.S. Pat. No. 5,561,978. The Buschur patent recognizes that the fan of an automotive cooling system may be driven by a pair of cooperatively connected gerotor motors, one of which may be termed a grade motor and the other of which may be termed an idle motor. Operating one or both motors allows a wide range of fan speeds at both idle and grade engine speeds. The present invention was implemented on a dual hydraulic gerotor motor system, as generally illustrated in FIGS. 3 and 4. As shown therein, motor/manifold assembly 12 comprises a grade gerotor motor 22 and an idle gerotor motor 24.

The preferred embodiment of this invention significantly improves the start-up torsional efficiency and motor-to-motor variation of the dual motor system. While this invention is applicable to both the grade and idle gerotor motors, most improvement was seen when the invention was applied to the grade gerotor motor. The reason can be explained by the different geometry of the grade and idle gerotor motors. At start-up, both gerotor motors contribute to the torque of the motor system in proportion to their volumetric displacement. The larger displacement grade gerotor motor is a "pocket" design with one clamped sealing surface and an undercut of the type shown in FIG. 2. This geometry is particularly prone to hydraulic imbalance. The smaller displacement idle gerotor motor has two clamped sealing surfaces and no undercut and is therefore less sensitive to hydraulic imbalance. The importance of balance grooves at the clamped sealing surface will become clear after the following explanation of the preferred embodiment.

Referring now to FIGS. 3 and 4, a manifold 10 is shown as part of a motor/manifold assembly 12. Other elements are an inlet 14, an outlet 16 and case drain 18. The manifold 10 has valving located at 20. A grade gerotor motor 22 and an idle gerotor motor 24 are positioned in a stacked assembly between manifold 10 and an endframe 26. A center plate 28 is positioned between idle gerotor motor 24 and grade gerotor motor 22, as shown in FIG. 4. An end plate 30 and a set of four bolts 32 serve to clamp the stacked assembly against manifold 10. Bolts 32 provide sufficient clamping force to prevent separation of the stack at rated operating pressures and also create a metal-to-metal seal between elements of the stacked assembly to eliminate the need for elastomeric seals. Any hydraulic fluid that leaks past the stacked assembly is contained within the motor by a shaft seal 34 and a manifold O-ring seal 36.

Figure 5:
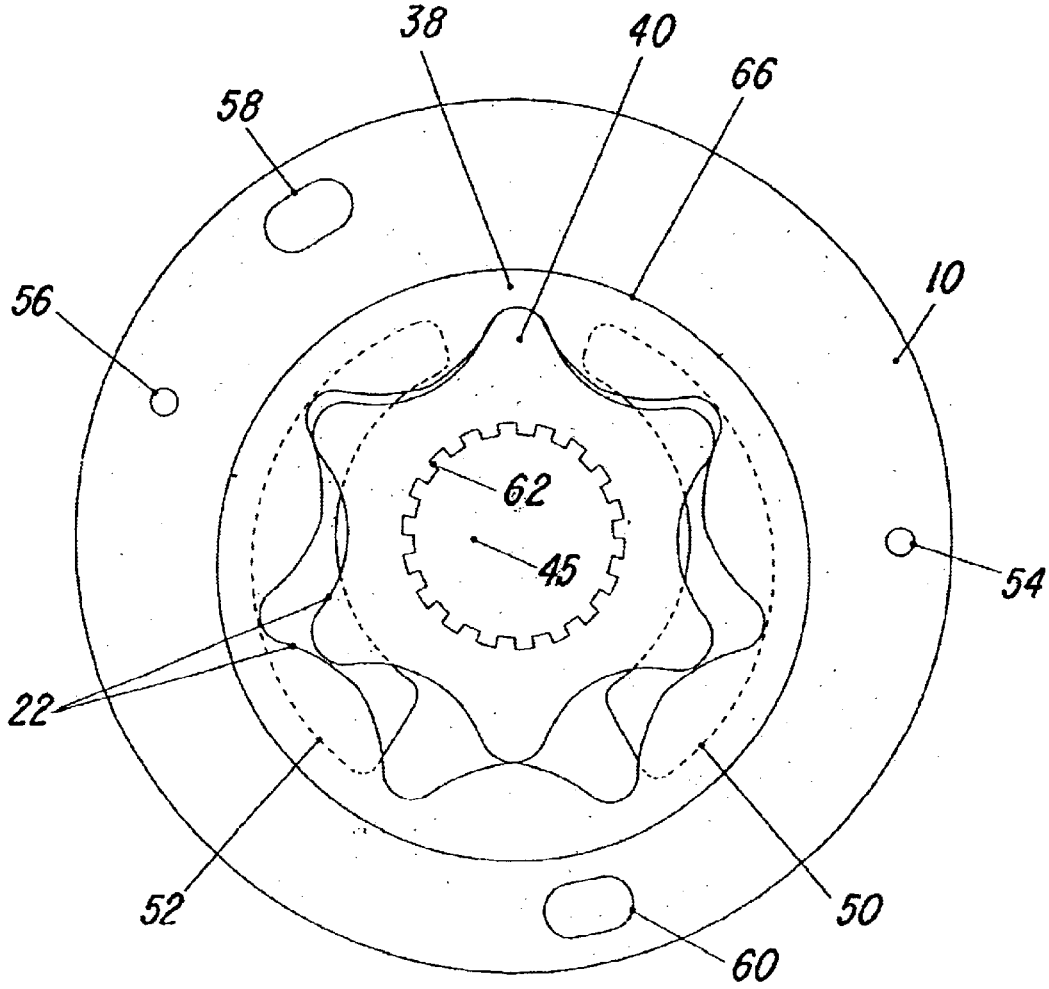
FIG. 5 is a sketch of a grade gerotor motor and associated kidney ports as viewed along lines 5—5 of FIG. 4.

As best shown in FIGS. 4 and 5, the grade gerotor motor 22 comprises an outer grade gear 38 and an inner grade gear 40. It should be understood that idle gerotor motor 24 comprises outer idle gear 42 and inner idle gear 44. Idle gerotor motor 24 rotates within idle ring 25 but otherwise is configured in a manner similar to grade gerotor motor 22, and the details thereof are not illustrated in the drawing. The two inner gears 40, 44 drive a common shaft 45 that transmits a torsional force to the load. A pair of alignment pins 46, 48 prevent rotation of the stacked assembly during motor operation.

In operation, hydraulic fluid enters the motor 22 through the inlet manifold port connection 14 (FIG. 3). Internal valving 20 directs this fluid to the inlet of either the idle gerotor set 42, 44 (FIG. 4) or the inlets of both the idle gerotor set 42, 44 and the grade gerotor set 38, 40. For ease of illustration, those particular connections are not illustrated herein, after passing through the gerotor motors 24 and 22, the hydraulic fluid exits through the outlet manifold port connection 16 (FIG. 4).

Referring now to FIG. 5, there appears a view of grade gerotor motor 22, as seen by looking downward along line 5—5 of FIG. 4. For a ready understanding of the geometrical relationships, contours of an inlet kidney port 50 and an outlet kidney port 52 are projected onto grade gerotor motor 22, as indicated by dashed lines thereon. A pair of apertures 54, 56 are provided for receiving alignment pins 46, 48. This prevents rotation of the motor stack assembly. Inlet and outlet flow to and from the idle gerotor set passes through ports 58 and 60 respectively. Inner gear 40 has an internal spline 62 that transmits torque to the drive shaft 45. Note that the outer gear 38 has one more tooth than the inner gear 40. This gerotor characteristic creates discrete chambers between gerotor teeth that expand as hydraulic fluid enters through the inlet kidney port 50 and contract as hydraulic fluid exits through outlet kidney port 52. The axes of gerotor gears are offset by a fixed distance. The cooperative action of gerotor gears in the presence of a hydraulic fluid is well known and need not be further described herein.

Figure 6:
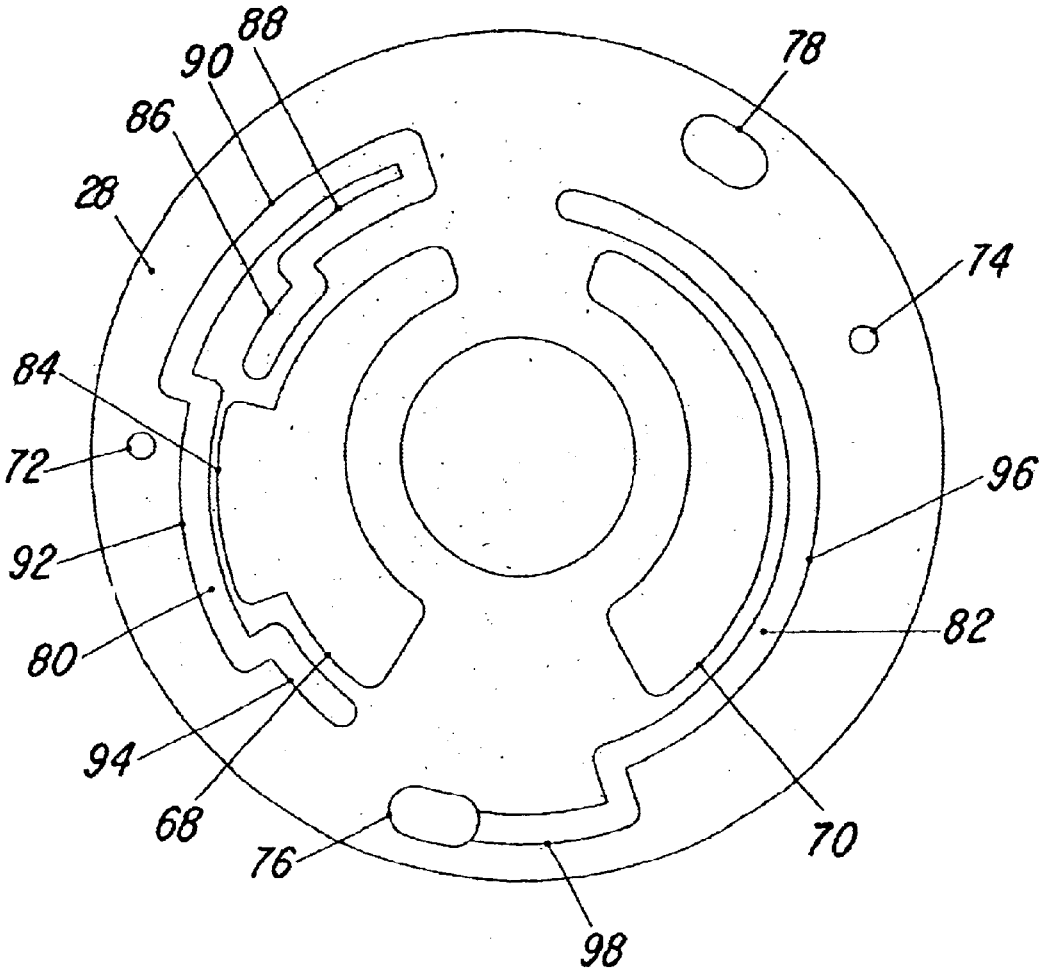
FIG. 6 is a sketch of a cover plate, showing the placement of balance grooves therein as viewed along lines 6—6 of FIG. 4.

Grade gerotor motor 22 is designed to rest in a pocket 66 defined by a recess in manifold 10. Pocket 66 is covered over and sealed (some leakage will occur) by center plate 28. This center plate 28 has "shadow" inlet and outlet kidney ports 68 and 70, respectively, as shown in FIG. 6. Alignment pins 46, 48 pass through holes 72 and 74 to prevent rotation of the motor stack. Ports 76 and 78 provide an outlet and inlet fluid connection, respectively to the idle gerotor set. A principal feature of the invention resides in balance grooves fashioned in the face of center plate 28, facing grade gerotor motor 22. In one embodiment there are three such balance grooves, including an axial balance groove 80, an outlet balance groove 82 and an inlet balance groove 84. Note that the axial balance groove 80 is made-up of individual groove segments labeled 86, 88, 90, 92, and 94. Likewise, the outlet balance groove 82 is made up of groove segments 96 and 98. Collectively, these grooves (80, 82 and 84) will be referred to as "balance grooves".

Figure 7:
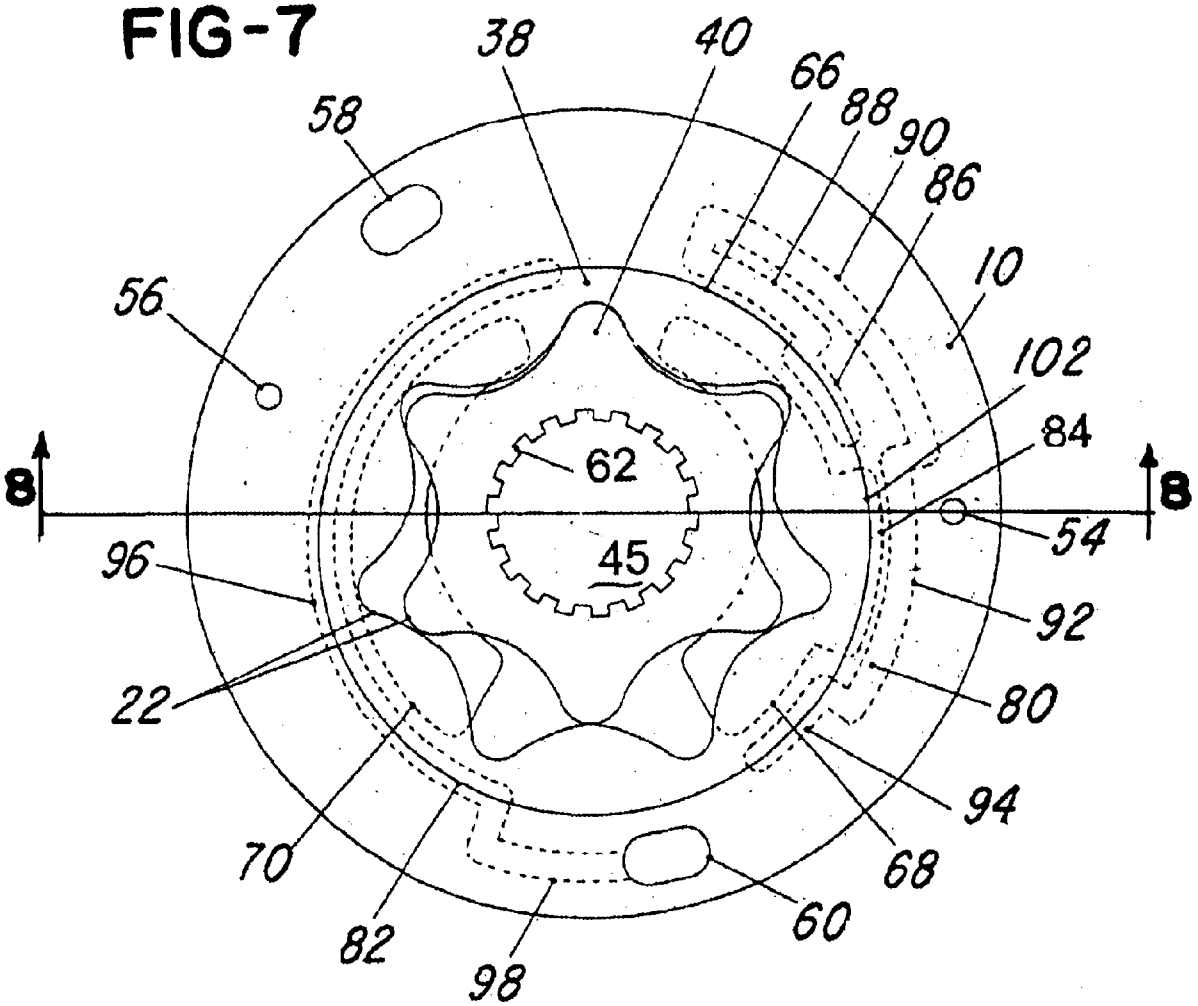
FIG. 7 is a sketch showing the relative positioning of balance grooves and a gerotor pocket.
Figure 8:
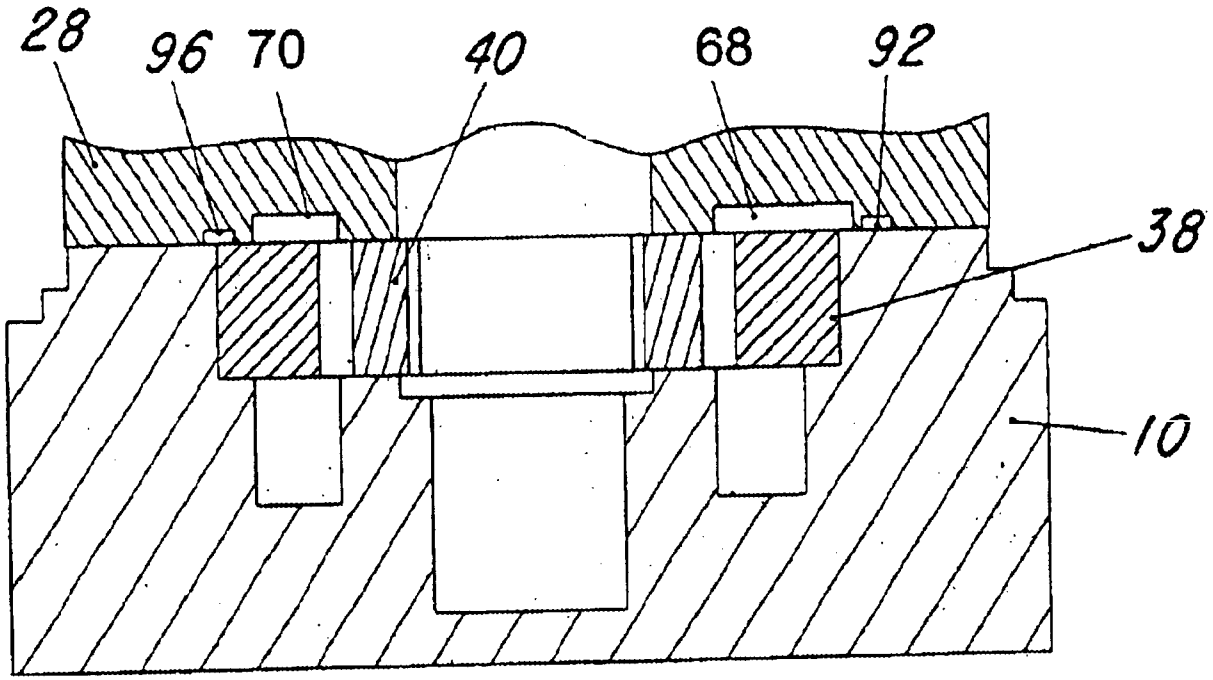
FIG. 8 is a cross sectional view taken along lines 8—8 of FIG. 7.

FIGS. 7 and 8 show the location of the balance grooves (80, 82 and 84) in relation to the manifold 10, inner grade gear 40 and outer grade gear 38. It is important to note that each of these grooves traverse a radial clearance 102 (FIG. 7) between an outer grade gear 38 and a cylindrical wall of pocket 66 in manifold 10. In this manner, the balance grooves are used to define the pressure gradient acting on the outside of the outer grade gear 38. Generally, fluid flow through the balance grooves is minimal. Therefore, the width and depth of the balance grooves is not critical, but should be larger in cross sectional area than the product of radial clearance 102 and axial gerotor thickness.

The purpose of balance grooves defined by this invention is to minimize the friction between the outer grade gear 38, manifold 10 and center plate 28. Any friction between these parts reduces the motor torque available at the load. This is particularly important because the outer grade gear 38 is at a relatively large radius from the shaft axis, thereby increasing the effective moment arm of any frictional force on this part.

Figure 9:
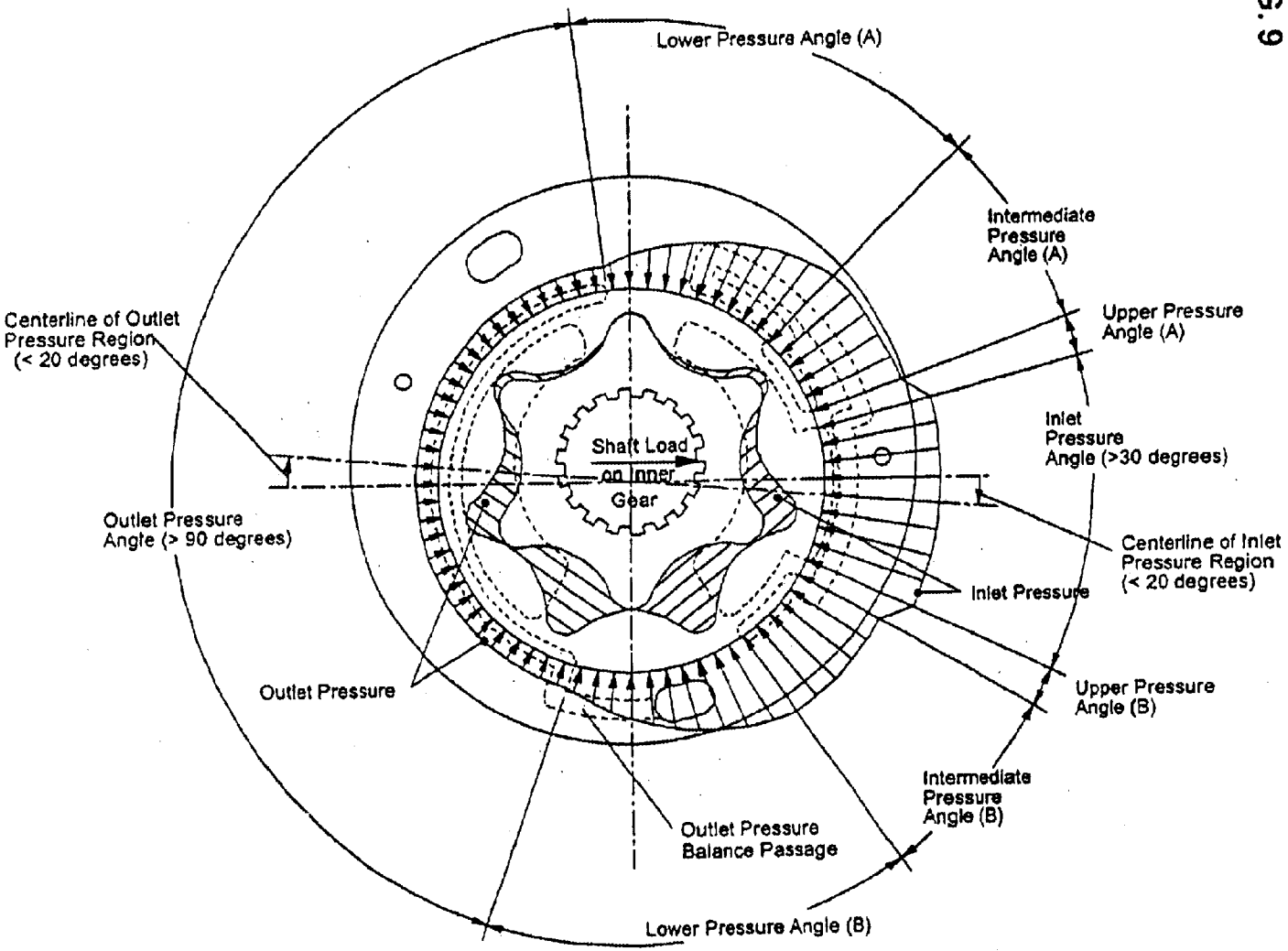
FIG. 9 shows the radial pressure profile for a gerotor motor having balance grooves in accordance with this invention.

FIG. 9 illustrates a typical plot of the radial pressure gradient acting on the periphery of an outer grade gear of a gerotor motor according to this invention. The gradient is divided into several regions as shown in this figure. First, note that the inlet balance groove 84 connects the inlet kidney port 68 to the radial clearance 102 between the outer grade gear 38 and the manifold pocket 66. This ports the "Inlet Pressure" to the outside of the outer grade gear 38 in the region labeled "Inlet Pressure Angle", causing the inner and outer radial pressure to be equal in this region. Likewise, the outlet balance groove 82 connects the outlet kidney port 70 via ports 60 and 76 to the radial clearance 102. This ports "Outlet Pressure" to the outside of the outer grade gear 38 in the region labeled "Outlet Pressure Angle", causing the inner and outer radial pressure to be equal in this region. In the preferred embodiment of this invention, the center lines of the "Inlet Pressure Angle" and "Outlet Pressure Angle" are coincident.

Since the radial clearance 102 exists around the outer grade gear 38, two pressure gradient regions, labeled (A) and (B) in FIG. 9, exist between the "Inlet Pressure Angle" and the "Outlet Pressure Angle." These gradient regions are divided into three parts labeled "Upper Pressure Angle", "Intermediate Pressure Angle", and "Lower Pressure Angle". In the preferred embodiment, pressure angles in region (A) and (B) are identical.

FIG. 9 clearly shows one of the major benefits of balance grooves 80, 82 and 84. Balance grooves 80, 82 and 84 fully define the radial pressures acting on the periphery of the outer gerotor, except for the gradient regions, making the net radial force on the outer grade gear 38 largely insensitive to clearances and leakage. This helps minimize motor-to-motor variations in torsional efficiency and virtually eliminates sensitivity to inlet or outlet pressure.

Axial balance groove 80 provides both radial and axial balance of the outer gerotor. As will be discussed below, the pressure in the axial balance groove 80 should always be at or near "inlet pressure". However, directly connecting this groove 80 to the inlet kidney port 68 can cause it to collect contamination from the hydraulic fluid. This can be catastrophic if stored contamination is suddenly reintroduced back into the motor. Instead, in the preferred embodiment, the axial balance groove 80 is configured so that both ends overlie, and are in fluid communication with, the radial clearance 102 between the outer perimeter of outer grade gear 38 and the cylindrical sidewall of pocket 66, as indicated in FIG. 7.

The meeting place of axial balance groove 80 and radial clearance 102 is situated in the regions defined as "Intermediate Pressure Angle" in FIG. 9. This prevents any large contaminants from entering the axial balance groove 80. Any small contaminants that enter the groove 80 are flushed out due to minor transient pressure differences at each end of the groove 80.

The pressure in the axial balance groove 80 depends upon the pressure within the radial clearance 102 at the location where contact with groove 80 occurs. By minimizing the arc length of the "Upper Pressure Angle", the pressure in the axial balance groove 80 is affixed near the inlet pressure as desired for axial pressure balance of the outer grade gear 38.

The axial balance groove 80 also causes the radial pressure forces acting on the outer gear in the "Intermediate Pressure Angle (A)" and "Intermediate Pressure Angle (B)" to be equal. This facilitates assuring that the forces on the outer gear 38 in these regions will be equal and again reduces the sensitivity of radial balance to clearance and leakage.

Balance grooves, defined by this invention, allow a designer to define the magnitude and direction of the net hydraulic radial force acting on the outer gerotor. By minimizing the net hydraulic radial force, the torsional frictional force is also minimized. Mathematically, this is accomplished by equating to zero the sum of the internal and external radial pressure forces acting on the outer gear. Gear tooth loads can be ignored since these are usually small compared to the pressure forces. Also, rotation of the gears causes the internal pressure force to change slightly in magnitude and direction requiring the use of an "average" internal force. The resulting mathematical equation can be used to find the angles shown in FIG. 9. When the balance grooves 80, 82 and 84 are sized to minimize the net hydraulic radial force, that force is virtually independent of both inlet and outlet pressure.

Balancing the outer gerotor radially as described above is not sufficient to assure good torsional efficiency. Axial pressure balance (along the axis of the shaft) is also necessary. Balance grooves 80, 82 and 84, as defined by this invention, serve to provide both radial and axial pressure balance.

Figure 1:
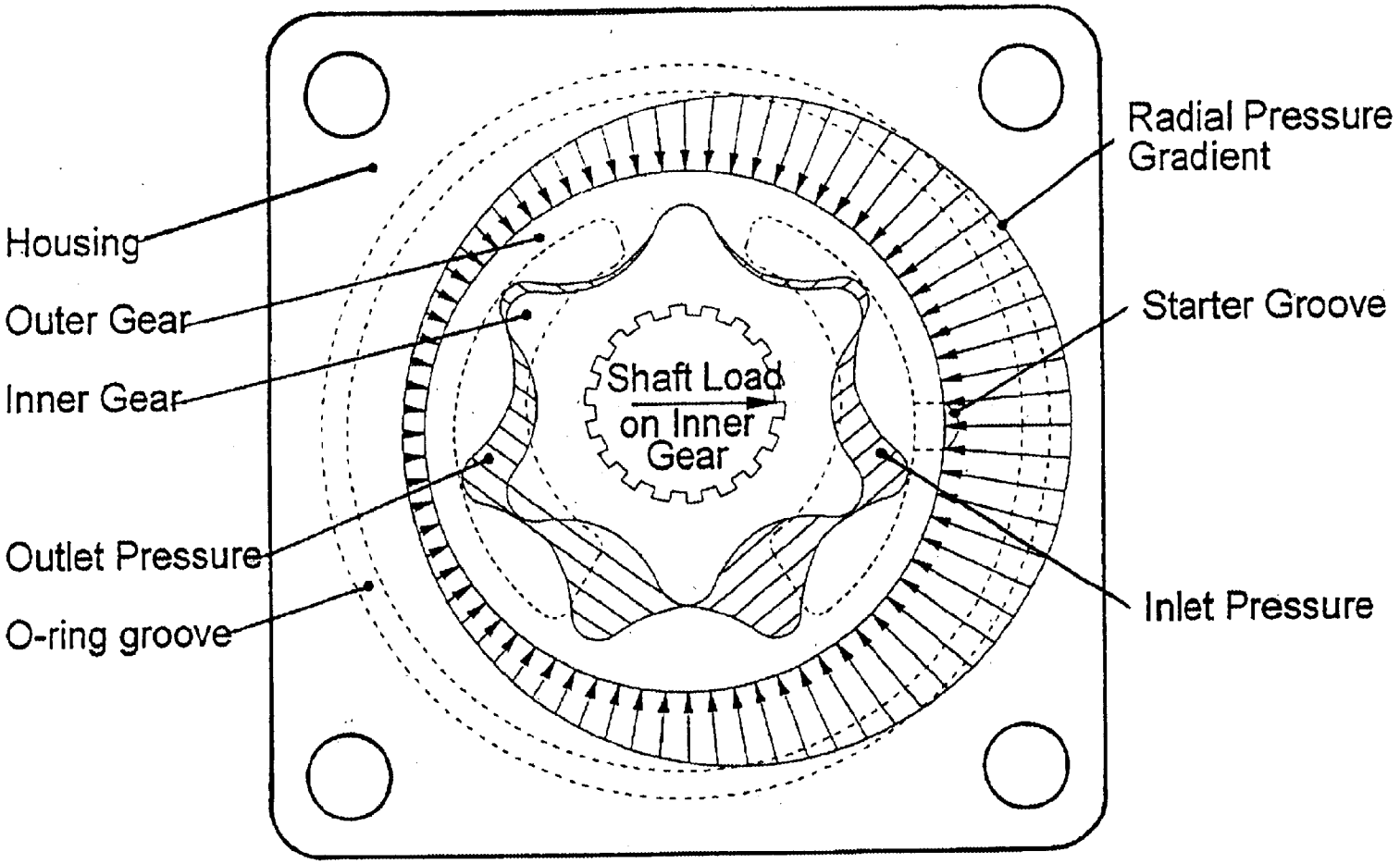
FIG-1 (PRIOR ART)
FIG. 1 shows a typical radial pressure profile in a prior art gerotor motor.
Figure 2:
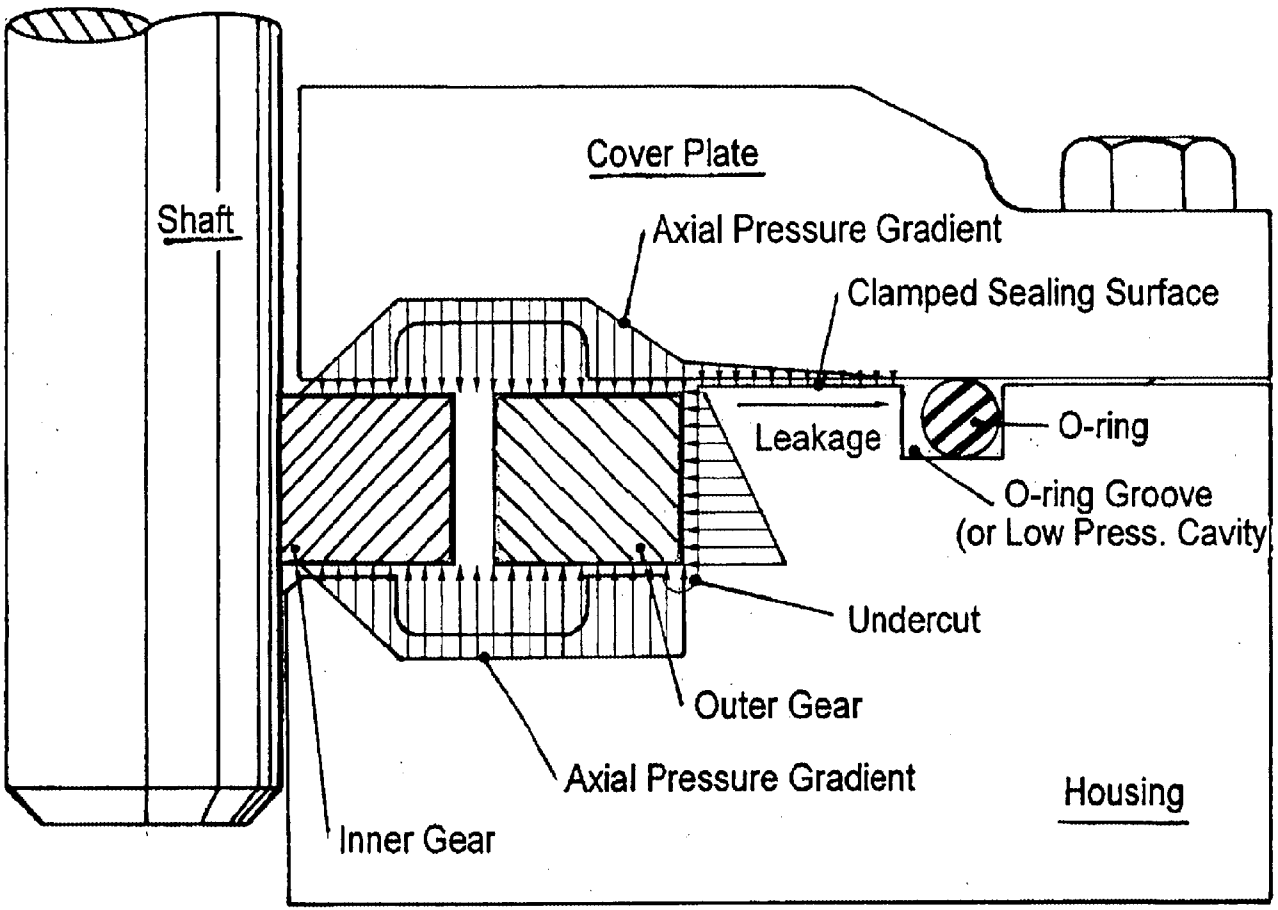
FIG-2 (PRIOR ART)
FIG. 2 shows a typical axial pressure profile in a prior art gerotor motor.

As discussed previously, leakage between the housing and cover plate of a gerotor motor can create an axial pressure imbalance on the outer grade gear (see FIG. 2). This is particularly true of a motor with a "pocket" design (only one sealing surface). Motors with two sealing surfaces (i.e, the idle gerotor motor 24 shown in FIG. 4) may have only minimal axial pressure imbalance if the leakage at both sealing surfaces is similar.

Another important factor affecting axial pressure balance is the cross-sectional area of the "undercut" often used in a pocket design. This undercut will distort the pressure gradient if the undercut is too large, a gerotor motor having two sealing surfaces does not need an undercut and therefore may have less frictional loss than a motor with a "pocket" design.

Figure 10:
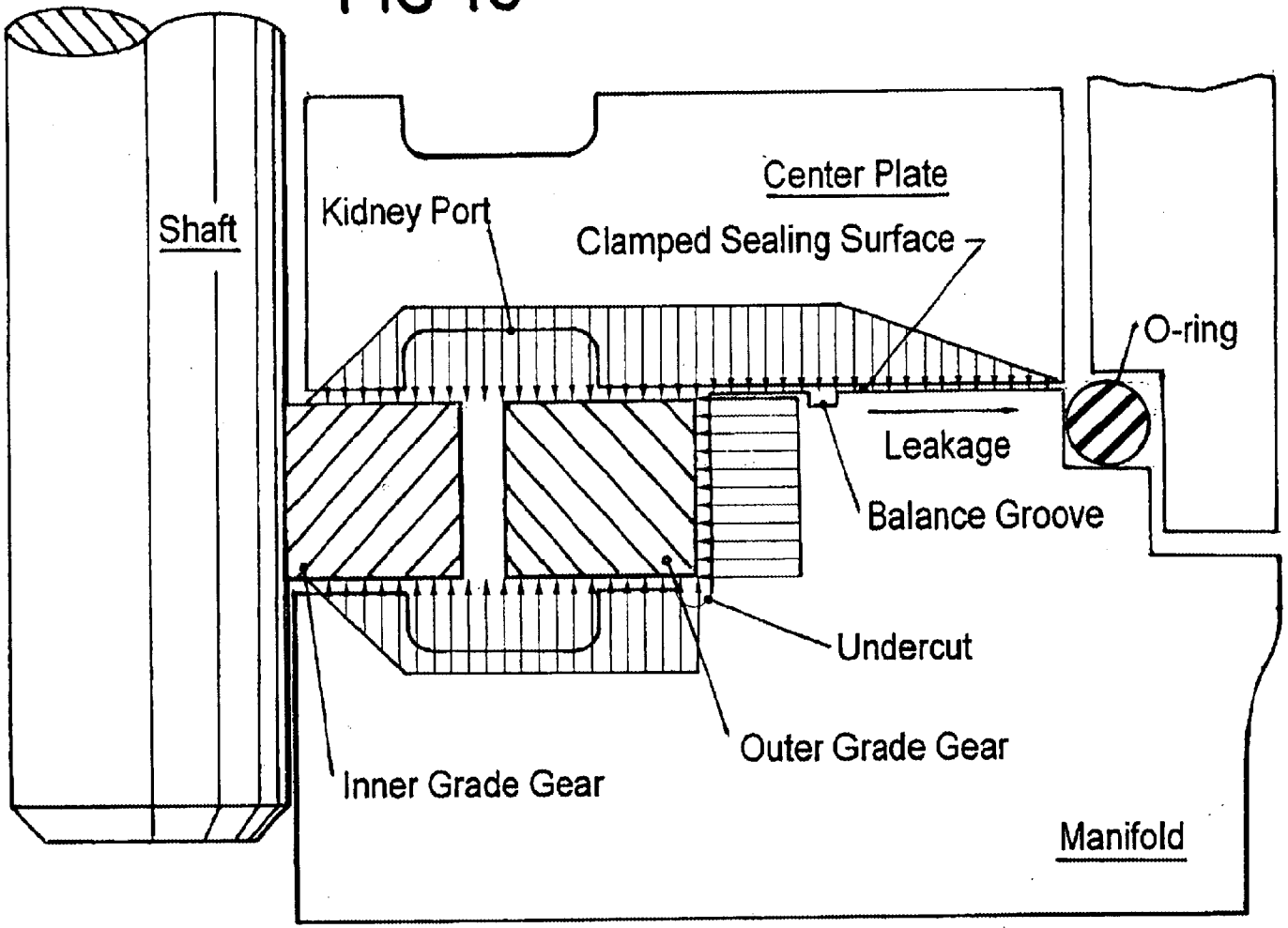
FIG. 10 shows the axial pressure profile for a gerotor motor having balance grooves in accordance with this invention.

As described above in the Description of the Related Art and shown in FIG. 2, leakage of hydraulic fluid can cause an axial pressure imbalance on an outer gear of a gerotor motor gear pair. FIG. 10 illustrates a cross-section for an inner and outer gear pair of a gerotor motor having balance grooves in accordance with the present invention. The figure shows typical pressure forces occurring in such an arrangement. If the pressure in balance groove 80, 82 and 84 is at or near the pressure in the adjacent "kidney port", then the balance groove between the manifold 10 and center plate 28 will prevent leakage from disturbing the pressure acting axially on the outer grade gear. Note that the radial location of the balance groove 80, 82 and 84 can be at the radial clearance 102 or beyond. For this reason, the axial balance groove segments 86, 88, 90, 92 and 94 and outlet balance groove segments 96, 98 all provide axial balancing for the gerotor, even though they are positioned at different radii from the shaft centerline.

It has been found through experiment that the performance of the invention is improved, if the axial balance groove 80 has an arc length approximately equal to the arc length of kidney port 68. The improvement is believed to be the result of improved axial balance. The following two examples demonstrate the utility of the invention.

EXAMPLE I

Start-up torsional efficiency tests were performed on eight motor/manifold assemblies constructed substantially as illustrated in FIGS. 3–8, but lacking balance grooves, as described above. The units were known to be poor starting units. The units were connected to a geared electric motor via a torque cell and driven at a relatively low speed of 1.3 rpm. They were supplied with hydraulic oil having a temperature of 110 deg. F., and an inlet flow rate of 2.0 gpm. The inlet pressure was varied from minimum to 1750 psig. Outlet pressure was 135 psig. Shaft torque was recorded and converted to torsional efficiency. The eight units were found to have average start-up torsional efficiencies ranging from −42.3 to +3.9 percent. (Note that a negative torsional efficiency indicates the motor would not start). Testing was repeated for outlet pressures of 500 and 1000 psig. Startability was poor and remained poor throughout the entire range of pressures. After these efficiency tests were run, the motor/manifold assemblies were disassembled and modified to have balance grooves according to this invention. They were then reassembled and retested by the same test procedure. The modified units were all found to start well and had start-up torsional efficiencies of 6.8 to 33.4 percent.

EXAMPLE II

A lot of thirty motor/manifolds, manufactured in accordance with this invention, were tested according to the procedure described in Example I. The average start-up torsional efficiency for the thirty-piece sample was 39.9 percent, with individual torsional efficiencies ranging between 23.5 and 47.5 percent. All units in the test lot started well.

The following is a discussion of design considerations applicable to the practice of this invention.

An outer gerotor gear according to this invention may have a sliding fit within the pocket of a housing and be enclosed with a cover plate. This outer gerotor spins easily in the pocket. The only rotational friction is from the outer gerotor rubbing against the pocket and cover plate. When the outer gerotor is operating, it has pressurized hydraulic fluid on the inside, outside and on both ends. This pressurized fluid tends to push the outer gerotor against the pocket both radially and axially. The friction is given by the classic physics equation:

$$F=\mu\times N$$

F=Frictional force (lbs)

$\mu$=Coefficient of friction

N=Normal force (lbs)

The torsional friction is simply the friction multiplied by the moment arm or:

$$T_f=R\times\mu\times N$$

$T_f$=Friction torque (inch lbs)

R=Moment arm (inch)

The torque generated by the motor is given by:

$$T_m=S\times DP/(2\times\pi)$$

$T_m$=Generated torque (inch lbs)

S=Motor displacement (inch^3/revolution)

DP=Pressure across the motor (Inlet pressure−Outlet pressure) (psi)

The torque available to drive the load is:

$$T_d=T_m-T_f$$

Note that if the frictional torque Tf equals the generated torque Tm then the motor stalls. The key to avoiding this problem is to "balance" all of the hydraulic forces acting on the outer gerotor so that it is never pressed tightly against the housing bore or cover plate. (Some rubbing will always occur but the unbalanced hydraulic force must be minimized.)

The prior art problems described earlier herein relative to variations in outside pressure gradient are solved by defining the pressure acting on the outside of the outer gerotor for most of the 360 degree circumference and minimizing the length of all pressure gradients. Referring to FIG. 9 hereof, note that the pressure acting on the outside of the outer gerotor at the "Inlet Pressure Angle" is inlet pressure. This is the result of the inlet balance groove 84. This pressure will not vary with clearances, because it is directly connected to the inlet port. Note as well that the pressure acting on the outside of the outer gerotor at the "Outlet Pressure Angle" in FIG. 9 is always outlet pressure. This pressure will not vary with clearances, because it is directly connected to the outlet port. Thus, the pressure acting on the outside of the outer gerotor is exactly defined for about 185 degrees of the circumference. This helps minimize motor-to-motor variation.

A designer can define the arc length of both the "Inlet Pressure Angle" and "Outlet Pressure Angle" in FIG. 9. FIG. 9 illustrates the outlet pressure region illustrated in the embodiment being described as being greater than 90 degrees, a centerline of the outlet pressure region being less than 20 degrees, an inlet pressure region being greater than 30 degrees, and an outlet pressure balance passage as shown. This allows the net pressure force acting on the outer gerotor to be "adjusted" in both magnitude and direction. The goal is to achieve zero net radial hydraulic force acting on the inside and outside of the outer gerotor at all inlet and outlet pressures. Variations in pressure force can still occur in the gradient regions but these are now much shorter in arc length and are therefore much less critical. It can be shown mathematically that the grooves shown in FIG. 9 provide approximately zero net radial hydraulic force at any inlet or outlet pressure. This is a substantial improvement over the prior art.

While the forms of apparatus herein described constitute preferred embodiments of the invention, it is to be understood that the invention is not limited to these precise forms of apparatus and that changes may be made therein without departing from the scope of the invention defined by the following claims.

What is claimed is:

1. A hydraulic gerotor motor comprising:

(a) a housing provided with a cylindrical gerotor bore;

(b) an outer gerotor gear mounted within said gerotor bore, said outer gerotor gear having a smooth, cylindrical outer perimeter facing said gerotor bore to define a region of radial clearance therebetween; and an inner perimeter equipped with inwardly extending teeth;

(c) an inner gerotor gear mounted within said outer gerotor gear, said inner gerotor gear having outwardly extending teeth engaging said inwardly extending teeth of said outer gerotor gear;

(d) an inlet port situated for receiving a flow of hydraulic fluid and delivering said hydraulic fluid to a region of engagement between said inwardly extending teeth and said outwardly extending teeth;

(e) an outlet port situated for discharging used hydraulic fluid from said device; and (f) a pressure balancing passage extending between said region of radial clearance and said inlet port;

wherein said pressure balancing passage causes creation of an inlet pressure region at said region of radial clearance, said inlet pressure region being centered within 20 degrees of a radial line perpendicular to an offset line joining said inner gerotor center and said outer gerotor center and having an arc length greater than 30 degrees.

2. A hydraulic gerotor motor comprising:

(a) a housing provided with a cylindrical gerotor bore;

(b) an outer gerotor gear mounted within said gerotor bore, said outer gerotor gear having a smooth, cylindrical outer perimeter facing said gerotor bore to define a region of radial clearance therebetween;, and an inner perimeter equipped with inwardly extending teeth;

(c) an inner gerotor gear mounted within said outer gerotor gear, said inner gerotor gear having outwardly extending teeth engaging said inwardly extending teeth of said outer gerotor gear;

(d) an inlet port situated for receiving a flow of hydraulic fluid and delivering said hydraulic fluid to a region of engagement between said inwardly extending teeth and said outwardly extending teeth;

(e) an outlet port situated for discharging used hydraulic fluid from said device; and (f) a pressure balancing passage extending between said region of radial clearance and said inlet port;

further comprising an outlet port situated for discharging hydraulic fluid from said device, and a pressure balancing passage extending between said region of radial clearance and said outlet port, said second pressure balancing passage causing creation of an outlet pressure region at said region of radial clearance, said outlet pressure region being centered within 20 degrees of a radial line perpendicular to an offset line joining said inner gear center and said outer gerotor center and having an arc length greater than 90 degrees.

3. A hydraulic gerotor motor comprising:

(a) a housing provided with a cylindrical gerotor bore;

(b) an outer gerotor gear mounted within said gerotor bore, said outer gerotor gear having a smooth, cylindrical outer perimeter facing said gerotor bore to define a region of radial clearance therebetween; and an inner perimeter equipped with inwardly extending teeth;

(c) an inner gerotor gear mounted within said outer gerotor gear, said inner gerotor gear having outwardly extending teeth engaging said inwardly extending teeth of said outer gerotor gear;

(d) an inlet port situated for receiving a flow of hydraulic fluid and delivering said hydraulic fluid to a region of engagement between said inwardly extending teeth and said outwardly extending teeth;

(e) an outlet port situated for discharging used hydraulic fluid from said device; and (f) a pressure balancing passage extending between said region of radial clearance and said inlet port;

further comprising an outlet port situated for discharging hydraulic fluid from said device, and a pressure balancing passage extending between said region of radial clearance and said outlet port, said second pressure passage balancing causing creation of an outlet pressure region at said region of radial clearance, said outlet pressure region being centered within 20 degrees of a radial line perpendicular to an offset line joining said inner gear center and said outer gerotor center and having an arc length greater than 90 degrees;

further comprising another passage between said cover plate and said gerotor gears, said another passage defining an axial balance groove extending to said region of radial clearance.

4. A hydraulic device comprising at least one passage connecting inlet pressure to a radial clearance area between an outer gerotor and outer gerotor bore defining an inlet pressure region at the radial clearance, the center of said inlet pressure region being located at a first predetermined number of degrees from a radial line perpendicular to a gerotor offset and having an arc length a second predetermined number of degrees;

wherein the device is a gerotor motor;

wherein said first predetermined number of degrees is less than or equal to 20 degrees.

5. A hydraulic device comprising at least one passage connecting inlet pressure to a radial clearance area between an outer gerotor and outer gerotor bore defining an inlet pressure region at the radial clearance, the center of said inlet pressure region being located at a first predetermined number of degrees from a radial line perpendicular to a gerotor offset and having an arc length a second predetermined number of degrees;

wherein the device is a gerotor motor;

wherein said second predetermined number of degrees is greater than or equal to 30 degrees.

6. A hydraulic device comprising at least one passage connecting inlet pressure to a radial clearance area between an outer gerotor and outer gerotor bore defining an inlet pressure region at the radial clearance, the center of said inlet pressure region being located at a first predetermined number of degrees from a radial line perpendicular to a gerotor offset and having an arc length a second predetermined number of degrees;

wherein the device is a gerotor motor;

wherein said first predetermined number of degrees is less than or equal to 20 degrees; and wherein said second predetermined number of degrees is greater than or equal to 30 degrees.

7. A hydraulic device comprising at least one passage connecting inlet pressure to a radial clearance area between an outer gerotor and outer gerotor bore defining an inlet pressure region at the radial clearance, the center of said inlet pressure region being located at a first predetermined number of degrees from a radial line perpendicular to a gerotor offset and having an arc length a second predetermined number of degrees wherein the device is a gerotor pump;

wherein said first predetermined number of degrees is less than or equal to 20 degrees.

8. A hydraulic device comprising at least one passage connecting inlet pressure to a radial clearance area between an outer gerotor and outer gerotor bore defining an inlet pressure region at the radial clearance, the center of said inlet pressure region being located at a first predetermined number of degrees from a radial line perpendicular to a gerotor offset and having an arc length a second predetermined number of degrees wherein the device is a gerotor pump;

wherein said second predetermined number of degrees is greater than or equal to 90 degrees.

9. A hydraulic device comprising at least one passage connecting inlet pressure to a radial clearance area between an outer gerotor and outer gerotor bore defining an inlet pressure region at the radial clearance, the center of said inlet pressure region being located at a first predetermined number of degrees from a radial line perpendicular to a gerotor offset and having an arc length a second predetermined number of degrees wherein the device is a gerotor pump;

wherein said first predetermined number of degrees is less than or equal to 20 degrees; and wherein said first predetermined number of degrees is greater than 90 degrees.

10. A hydraulic gerotor motor comprising:

(a) a housing with first planar surface; a pocket defined by a blind cylindrical opening extending perpendicularly into the said first planar surface, said pocket having a cylindrical side wall terminated by second planar surface, said second planar surface parallel to first planar surface;

(b) a cover plate with planar surface clamped against said housing first planar surface to seal said pocket;

(c) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between housing second planar surface and said cover plate planar surface.

(d) an inner gerotor gear mounted within said outer gerotor gear, said inner gerotor gear having outwardly extending teeth engaging said inwardly extending teeth of said outer gerotor gear, said inner gear having one less tooth than outer gear;

(e) a output shaft connected to and driven by said inner gerotor gear, (f) an inlet port situated for receiving flow of hydraulic fluid and delivering said hydraulic fluid to a region of engagement between said inwardly extending teeth and said outwardly extending teeth;

(g) an outlet port situated for discharging used hydraulic fluid; and (h) a pressure balancing passage extending between said region of radial clearance and said inlet port, said pressure balancing passage causing creation of an inlet pressure region at said region of radial clearance, said inlet pressure region being centered within 20 degrees of a radial line from axis of said outer gerotor gear and perpendicular to a line joining said inner gerotor gear center and said outer gerotor gear center, said inlet pressure region having an arc length greater than 30 degrees.

11. A hydraulic gerotor motor according to claim 10, with a second pressure balancing passage extending between said region of radial clearance and said outlet port, said second pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 90 degrees.

12. A hydraulic gerotor motor according to claim 11, with a third pressure balancing passage defining an axial balance groove, said axial balance groove extending from said region of radial clearance, extending between said cover plate and said housing at a radius outside said region of radial clearance and extending to a second contact with said region of radial clearance.

13. A hydraulic gerotor motor comprising:

(a) a housing with first planar surface; a pocket defined by a blind cylindrical opening extending perpendicularly into the said first planar surface, said pocket having a cylindrical side wall terminated by second planar surface, said second planar surface parallel to first planar surface;

(b) a cover plate with planar surface clamped against said housing first planar surface to seal said pocket;

(c) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between housing second planar surface and said cover plate planar surface;

(d) an inner gerotor gear mounted within said outer gerotor gear, said inner gerotor gear having outwardly extending teeth engaging said inwardly extending teeth of said outer gerotor gear, said inner gear having one less tooth than outer gear;

(e) a output shaft connected to and driven by said inner gerotor gear;

(f) an inlet port situated for receiving flow of hydraulic fluid and delivering said hydraulic fluid to a region of engagement between said inwardly extending teeth and said outwardly extending teeth;

(g) an outlet port situated for discharging used hydraulic fluid; and (h) a pressure balancing passage extending between said region of radial clearance and said outlet port, said pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 90 degrees.

14. A hydraulic gerotor motor according to claim 13, with a second pressure balancing passage defining an axial balance groove, said axial balance groove extending from said region of radial clearance, extending between said cover plate and said housing at a radius outside said region of radial clearance and extending to a second contact with said region of radial clearance.

15. A hydraulic gerotor motor comprising:

(a) a housing with first planar surface; a pocket defined by a blind cylindrical opening extending perpendicularly into the said first planar surface, said pocket having a cylindrical side wall terminated by second planar surface, said second planar surface parallel to first planar surface;

(b) a cover plate with planar surface clamped against said housing first planar surface to seal said pocket;

(c) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between housing second planar surface and said cover plate planar surface;

(d) an inner gerotor gear mounted within said outer gerotor gear, said inner gerotor gear having outwardly extending teeth engaging said inwardly extending teeth of said outer gerotor gear, said inner gear having one less tooth than outer gear;

(e) a output shaft connected to and driven by said inner gerotor gear;

(f) an inlet port situated for receiving flow of hydraulic fluid and delivering said hydraulic fluid to a region of engagement between said inwardly extending teeth and said outwardly extending teeth;

(g) an outlet port situated for discharging used hydraulic fluid; and (h) a pressure balancing passage defining an axial balance groove, said axial balance groove extending from said region of radial clearance, extending between said cover plate and said housing at a radius outside said region of radial clearance and extending to a second contact with said region of radial clearance.

16. A hydraulic gerotor motor comprising:

(a) a housing with two planar and parallel surfaces; a cylindrical opening extending perpendicularly through both planar surfaces defining a cylindrical side wall;

(b) a first cover plate with planar surface clamped against said housing planar surface to define a pocket;

(c) a second cover plate with planar surface clamped against second of said housing planar surface to seal said pocket;

(d) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between said first cover plate and second cover plate;

(e) an inner gerotor gear mounted within said outer gerotor gear, said inner gerotor gear having outwardly extending teeth engaging said inwardly extending teeth of said outer gerotor gear, said inner gear having one less tooth than outer gear;

(f) a output shaft connected to and driven by said inner gerotor gear;

(g) an inlet port situated for receiving flow of hydraulic fluid and delivering said hydraulic fluid to a region of engagement between said inwardly extending teeth and said outwardly extending teeth;

(h) an outlet port situated for discharging used hydraulic fluid; and (i) a pressure balancing passage extending between said region of radial clearance and said inlet port, said pressure balancing passage causing creation of an inlet pressure region at said region of radial clearance, said inlet pressure region being centered within 20 degrees of a radial line from axis of said outer gerotor gear and perpendicular to a line joining said inner gerotor gear center and said outer gerotor gear, center, said inlet pressure region having an arc length greater than 30 degrees.

17. A hydraulic gerotor motor according to claim 16, with a second pressure balancing passage extending between said region of radial clearance and said outlet port, said second pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 90 degrees.

18. A hydraulic gerotor motor according to claim 17, with a third pressure balancing passage defining an axial balance groove, said axial balance groove extending from said region of radial clearance, extending between said first cover plate and said housing at a radius outside said region of radial clearance and extending to a second contact with said region of radial clearance.

19. A hydraulic gerotor motor according to claim 18, with a forth pressure balancing passage defining an axial balance groove, said axial balance groove extending from said region of radial clearance, extending between said second cover plate and said housing at a radius outside said region of radial clearance and extending to a second contact with said region of radial clearance.

20. A hydraulic gerotor motor comprising:

(a) a housing with two planar and parallel surfaces; a cylindrical opening extending perpendicularly through both planar surfaces defining a cylindrical side wall;

(b) a first cover plate with planar surface clamped against said housing planar surface to define a pocket;

(c) a second cover plate with planar surface clamped against second of said housing planar surface to seal said pocket;

(d) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between said first cover plate and second cover plate;

(e) an inner gerotor gear mounted within said outer gerotor gear, said inner gerotor gear having outwardly extending teeth engaging said inwardly extending teeth of said outer gerotor gear, said inner gear having one less tooth than outer gear;

(f) a output shaft connected to and driven by said inner gerotor gear;

(g) an inlet port situated for receiving flow of hydraulic fluid and delivering said hydraulic fluid to a region of engagement between said inwardly extending teeth and said outwardly extending teeth;

(h) an outlet port situated for discharging used hydraulic fluid; and (i) a pressure balancing passage extending between said region of radial clearance and said outlet port, said pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 90 degrees.

21. A hydraulic gerotor motor according to claim 20, with a second pressure balancing passage defining an axial balance groove, said axial balance groove extending from said region of radial clearance, extending between said first cover plate and said housing at a radius outside said region of radial clearance and extending to a second contact with said region of radial clearance.

22. A hydraulic gerotor motor according to claim 21, with a third pressure balancing passage defining an axial balance groove, said axial balance groove extending from said region of radial clearance, extending between said second cover plate and said housing at a radius outside said region of radial clearance and extending to a second contact with said region of radial clearance.

23. A hydraulic gerotor motor comprising:

(a) a housing with two planar and parallel surfaces; a cylindrical opening extending perpendicularly through both planar surfaces defining a cylindrical side wall;

(b) a first cover plate with planar surface clamped against said housing planar surface to define a pocket;

(c) a second cover plate with planar surface clamped against second of said housing planar surface to seal said pocket;

(d) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between said first cover plate and second cover plate;

(e) an inner gerotor gear mounted within said outer gerotor gear, said inner gerotor gear having outwardly extending teeth engaging said inwardly extending teeth of said outer gerotor gear, said inner gear having one less tooth than outer gear;

(f) a output shaft connected to and driven by said inner gerotor gear;

(g) an inlet port situated for receiving flow of hydraulic fluid and delivering said hydraulic fluid to a region of engagement between said inwardly extending teeth and said outwardly extending teeth;

(h) an outlet port situated for discharging used hydraulic fluid; and (i) a pressure balancing passage defining an axial balance groove, said axial balance groove extending from said region of radial clearance, extending between said first cover plate and said housing at a radius outside said region of radial clearance and extending to a second contact with said region of radial clearance.

24. A hydraulic gerotor motor according to claim 23, with a second pressure balancing passage defining an axial balance groove, said axial balance groove extending from said region of radial clearance, extending between said second cover plate and said housing at a radius outside said region of radial clearance and extending to a second contact with said region of radial clearance.

25. A hydraulic gerotor pump comprising:

(a) a housing with first planar surface; a pocket defined by a blind cylindrical opening extending perpendicularly into the said first planar surface, said pocket having a cylindrical side wall terminated by second planar surface, said second planar surface parallel to first planar surface;

(b) a cover plate with planar surface clamped against said housing first planar surface to seal said pocket;

(c) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between housing second planar surface and said cover plate planar surface, (d) an inner gerotor gear mounted within said outer gerotor gear, said inner gerotor gear having outwardly extending teeth engaging said inwardly extending teeth of said outer gerotor gear, said inner gear having one less tooth than outer gear;

(e) an input shaft connected to and driving said inner gerotor gear, (f) an inlet port situated for receiving flow of hydraulic fluid and delivering said hydraulic fluid to a region of engagement between said inwardly extending teeth and said outwardly extending teeth;

(g) an outlet port situated for discharging used hydraulic fluid; and (h) a pressure balancing passage extending between said region of radial clearance and said inlet port, said pressure balancing passage causing creation of an inlet pressure region at said region of radial clearance, said inlet pressure region being centered within 20 degrees of a radial line from axis of said outer gerotor gear and perpendicular to a line joining said inner gerotor gear center and said outer gerotor gear center, said inlet pressure region having an arc length greater than 90 degrees.

26. A hydraulic gerotor pump according to claim 25, with a second pressure balancing passage extending between said region of radial clearance and said outlet port, said second pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 30 degrees.

27. A hydraulic gerotor pump according to claim 26, with a third pressure balancing passage defining an axial balance groove, said axial balance groove extending from said region of radial clearance, extending between said cover plate and said housing at a radius outside said region of radial clearance and extending to a second contact with said region of radial clearance.

28. A hydraulic gerotor pump comprising:

(a) a housing with first planar surface; a pocket defined by a blind cylindrical opening extending perpendicularly into the said first planar surface, said pocket having a cylindrical side wall terminated by second planar surface, said second planar surface parallel to first planar surface;

(b) a cover plate with planar surface clamped against said housing first planar surface to seal said pocket;

(c) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between housing second planar surface and said cover plate planar surface;

(d) an inner gerotor gear mounted within said outer gerotor gear, said inner gerotor gear having outwardly extending teeth engaging said inwardly extending teeth of said outer gerotor gear, said inner gear having one less tooth than outer gear;

(e) an input shaft connected to and driving said inner gerotor gear;

(f) an inlet port situated for receiving flow of hydraulic fluid and delivering said hydraulic fluid to a region of engagement between said inwardly extending teeth and said outwardly extending teeth;

(g) an outlet port situated for discharging used hydraulic fluid; and (h) a pressure balancing passage extending between said region of radial clearance and said outlet port, said pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 30 degrees.

29. A hydraulic gerotor pump according to claim 28, with a second pressure balancing passage defining an axial balance groove, said axial balance groove extending from said region of radial clearance, extending between said cover plate and said housing at a radius outside said region of radial clearance and extending to a second contact with said region of radial clearance.

30. A hydraulic gerotor pump comprising:

(a) a housing with first planar surface; a pocket defined by a blind cylindrical opening extending perpendicularly into the said first planar surface, said pocket having a cylindrical side wall terminated by second planar surface, said second planar surface parallel to first planar surface;

(b) a cover plate with planar surface clamped against said housing first planar surface to seal said pocket;

(c) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between housing second planar surface and said cover plate planar surface;

(d) an inner gerotor gear mounted within said outer gerotor gear, said inner gerotor gear having outwardly extending teeth engaging said inwardly extending teeth of said outer gerotor gear, said inner gear having one less tooth than outer gear;

(e) an input shaft connected to and driving said inner gerotor gear;

(f) an inlet port situated for receiving flow of hydraulic fluid and delivering said hydraulic fluid to a region of engagement between said inwardly extending teeth and said outwardly extending teeth;

(g) an outlet port situated for discharging used hydraulic fluid; and (h) a pressure balancing passage defining an axial balance groove, said axial balance groove extending from said region of radial clearance, extending between said cover plate and said housing at a radius outside said region of radial clearance and extending to a second contact with said region of radial clearance.

31. A hydraulic gerotor pump comprising:

(a) a housing with two planar and parallel surfaces; a cylindrical opening extending perpendicularly through both planar surfaces defining a cylindrical side wall;

(b) a first cover plate with planar surface clamped against said housing planar surface to define a pocket;

(c) a second cover plate with planar surface clamped against second of said housing planar surface to seal said pocket;

(d) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between said first cover plate and second cover plate;

(e) an inner gerotor gear mounted within said outer gerotor gear, said inner gerotor gear having outwardly extending teeth engaging said inwardly extending teeth of said outer gerotor gear, said inner gear having one less tooth than outer gear;

(f) an input shaft connected to and driving said inner gerotor gear;

(g) an inlet port situated for receiving flow of hydraulic fluid and delivering said hydraulic fluid to a region of engagement between said inwardly extending teeth and said outwardly extending teeth;

(h) an outlet port situated for discharging used hydraulic fluid; and (i) a pressure balancing passage extending between said region of radial clearance and said inlet port, said pressure balancing passage causing creation of an inlet pressure region at said region of radial clearance, said inlet pressure region being centered within 20 degrees of a radial line from axis of said outer gerotor gear and perpendicular to a line joining said inner gerotor gear center and said outer gerotor gear center, said inlet pressure region having an arc length greater than 90 degrees.

32. A hydraulic gerotor pump according to claim 31, with a second pressure balancing passage extending between said region of radial clearance and said outlet port, said second pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said outlet pressure region having an arc length greater than 30 degrees.

33. A hydraulic gerotor pump according to claim 32, with a third pressure balancing passage defining an axial balance groove, said axial balance groove extending from said region of radial clearance, extending between said first cover plate and said housing at a radius outside said region of radial clearance and extending to a second contact with said region of radial clearance.

34. A hydraulic gerotor pump according to claim 33, with a forth pressure balancing passage defining an axial balance groove, said axial balance groove extending from said region of radial clearance, extending between said second cover plate and said housing at a radius outside said region of radial clearance and extending to a second contact with said region of radial clearance.

35. A hydraulic gerotor pump comprising:

(a) a housing with two planar and parallel surfaces; a cylindrical opening extending perpendicularly through both planar surfaces defining a cylindrical side wall;

(b) a first cover plate with planar surface clamped against said housing planar surface to define a pocket;

(c) a second cover plate with planar surface clamped against second of said housing planar surface to seal said pocket;

(d) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between said first cover plate and second cover plate;

(e) an inner gerotor gear mounted within said outer gerotor gear, said inner gerotor gear having outwardly extending teeth engaging said inwardly extending teeth of said outer gerotor gear, said inner gear having one less tooth than outer gear;

(f) an input shaft connected to and driving said inner gerotor gear;

(g) an inlet port situated for receiving flow of hydraulic fluid and delivering said hydraulic fluid to a region of engagement between said inwardly extending teeth and said outwardly extending teeth;

(h) an outlet port situated for discharging used hydraulic fluid; and (i) a pressure balancing passage extending between said region of radial clearance and said outlet port, said pressure balancing passage causing creation of an outlet pressure region at said region of radial clearance, said outlet pressure region being centered within 20 degrees of a radial line from axis of said outer gerotor gear and perpendicular to a line joining said inner gerotor gear center and said outer gerotor gear center, said inlet pressure region having an arc length greater than 30 degrees.

36. A hydraulic gerotor pump according to claim 35, with a second pressure balancing passage defining an axial balance groove, said axial balance groove extending from said region of radial clearance, extending between said first cover plate and said housing at a radius outside said region of radial clearance and extending to a second contact with said region of radial clearance.

37. A hydraulic gerotor pump according to claim 36, with a third pressure balancing passage defining an axial balance groove, said axial balance groove extending from said region of radial clearance, extending between said second cover plate and said housing at a radius outside said region of radial clearance and extending to a second contact with said region of radial clearance.

38. A hydraulic gerotor pump comprising:

(a) a housing with two planar and parallel surfaces; a cylindrical opening extending perpendicularly through both planar surfaces defining a cylindrical side wall;

(b) a first cover plate with planar surface clamped against said housing planar surface to define a pocket;

(c) a second cover plate with planar surface clamped against second of said housing planar surface to seal said pocket;

(d) an outer gerotor gear mounted within said pocket, said outer gerotor gear having a cylindrical outer perimeter facing said cylindrical side wall to define a region of radial clearance there between; inner perimeter of said outer gerotor gear equipped with inwardly extending teeth; said outer gerotor gear having two planar parallel surfaces perpendicular to said cylindrical outer perimeter; said planar surfaces providing a close running fit between said first cover plate and second cover plate;

(e) an inner gerotor gear mounted within said outer gerotor gear, said inner gerotor gear having outwardly extending teeth engaging said inwardly extending teeth of said outer gerotor gear, said inner gear having one less tooth than outer gear;

(f) an input shaft connected to and driving said inner gerotor gear;

(g) an inlet port situated for receiving flow of hydraulic fluid and delivering said hydraulic fluid to a region of engagement between said inwardly extending teeth and said outwardly extending teeth;

(h) an outlet port situated for discharging used hydraulic fluid; and (i) a pressure balancing passage defining an axial balance groove, said axial balance groove extending from said region of radial clearance, extending between said first cover plate and said housing at a radius outside said region of radial clearance and extending to a second contact with said region of radial clearance.

39. A hydraulic gerotor pump according to claim 38, with a second pressure balancing passage defining an axial balance groove, said axial balance groove extending from said region of radial clearance, extending between said second cover plate and said housing at a radius outside said region of radial clearance and extending to a second contact with said region of radial clearance.

* * * * *